US009709362B2

(12) United States Patent
Shelley

(10) Patent No.: US 9,709,362 B2
(45) Date of Patent: Jul. 18, 2017

(54) ADAPTIVE CAMOUFLAGE

(71) Applicant: Kevin Shelley, Salt Lake City, UT (US)

(72) Inventor: Kevin Shelley, Salt Lake City, UT (US)

( * ) Notice: Subject to any disclaimer, the term of this patent is extended or adjusted under 35 U.S.C. 154(b) by 647 days.

(21) Appl. No.: 14/066,555

(22) Filed: Oct. 29, 2013

(65) Prior Publication Data

US 2014/0230115 A1 Aug. 21, 2014

Related U.S. Application Data

(60) Provisional application No. 61/719,771, filed on Oct. 29, 2012.

(51) Int. Cl.

| | |
|---|---|
| ***F41H 3/02*** | (2006.01) |
| ***A45F 5/02*** | (2006.01) |
| ***A41D 27/08*** | (2006.01) |
| ***A45F 3/14*** | (2006.01) |
| ***A41D 29/00*** | (2006.01) |
| *A45F 3/00* | (2006.01) |

(52) U.S. Cl.

CPC ..... *F41H 3/02* (2013.01); *A41D 27/08* (2013.01); *A41D 29/00* (2013.01); *A45F 3/14* (2013.01); *A45F 5/02* (2013.01); *A41D 2400/20* (2013.01); *A41D 2600/108* (2013.01); *A45F 2003/001* (2013.01)

(58) Field of Classification Search

CPC ..... A41D 2600/108; A41D 13/0543; A41D 13/08; A41D 27/08; A41D 13/0156; A41D 13/0556; A41D 13/0568; A41D 27/22; A41D 2200/10; A41D 2300/33; A41D 2300/332; A41D 29/00; A41D 2400/20; A45F 2005/008; A45F 5/08; A45F 2200/0566; A45F 3/14; A45F 5/02; A45F 2003/001; F41H 3/02; F41H 3/00

USPC ..... 2/22, 24, 16; 224/222, 223, 250, 267

See application file for complete search history.

(56) References Cited

U.S. PATENT DOCUMENTS

| | | | | |
|---|---|---|---|---|
| 1,702,890 A * | 2/1929 | Brauer | A63B 57/203 224/223 |
| 2,102,515 A * | 12/1937 | Connell | A45F 5/00 211/70.6 |
| 2,744,348 A | 3/1953 | Smith | |

(Continued)

FOREIGN PATENT DOCUMENTS

| | | |
|---|---|---|
| CN | 102269543 | 12/2011 |
| RU | 2216261 C2 | 11/2003 |

(Continued)

OTHER PUBLICATIONS

PCT/US2013/067344 International Search Report and Written Opinion, Mar. 13, 2014.

*Primary Examiner* — Amy Vanatta
(74) *Attorney, Agent, or Firm* — Kunzler Law Group

(57) ABSTRACT

An apparatus, system, and method are disclosed for retaining camouflage material. A frame includes a front surface and a back surface. The frame may be configured to distribute pressure across the back surface from camouflage material retained against the front surface. At least one retention device may be coupled to the frame. The retention device(s) may be configured to retain camouflage material against the front surface of the frame. At least one vent opening may be formed in the frame. A vent opening may include a channel extending between the front surface and the back surface of the frame.

16 Claims, 10 Drawing Sheets

(56) References Cited

U.S. PATENT DOCUMENTS 2,911,652 A * 11/1959 Ekman ..... A42B 3/003 2/175.6
3,119,729 A * 1/1964 Ljungbo ..... B29C 43/22 156/279
3,703,728 A * 11/1972 Saunders ..... A41D 13/08 2/16
3,899,620 A * 8/1975 Roeloffzen ..... F41H 3/02 264/103
4,085,872 A * 4/1978 Foo ..... A63B 61/00 2/250
4,373,213 A * 2/1983 Erlandson ..... A41D 13/08 2/16
4,792,471 A * 12/1988 Lee ..... F41H 3/00 2/900
5,010,589 A * 4/1991 Hamilton ..... A41D 13/00 2/1
5,072,738 A * 12/1991 Wonder ..... A61F 15/008 128/846
5,154,506 A * 10/1992 Leard ..... F21L 15/14 224/222
5,199,621 A * 4/1993 McLennan ..... A45F 5/00 224/223
5,301,370 A * 4/1994 Henson ..... A63B 71/1225 2/22
5,370,288 A * 12/1994 Field ..... A45C 13/02 211/60.1
5,405,312 A * 4/1995 Jacobs ..... A61F 13/04 128/892
5,446,953 A * 9/1995 LeFeber ..... A45F 5/00 224/222
5,625,896 A * 5/1997 LaBarbera ..... A63B 71/1225 2/22
5,638,544 A * 6/1997 Sump ..... A42B 3/003 2/422
5,742,985 A 4/1998 Larrabee
5,842,584 A * 12/1998 Baird ..... B25F 5/029 206/379
5,967,391 A * 10/1999 Hunt ..... A01M 31/004 224/222
6,098,558 A * 8/2000 Baird ..... B25F 5/029 112/413
6,127,007 A * 10/2000 Cox ..... F41H 3/00 2/1
6,363,536 B1 * 4/2002 Sloan ..... A41D 19/0051 2/163
6,378,745 B1 * 4/2002 De Luccia ..... A47G 25/1435 223/85
6,474,520 B1 * 11/2002 Finkelstein ..... A45F 5/00 224/219
6,654,960 B2 * 12/2003 Cho ..... A63B 71/1225 2/22
6,745,400 B1 6/2004 Paciorkowshi
6,851,126 B1 * 2/2005 Humphreys ..... A41D 13/00 2/243.1
7,987,522 B2 8/2011 Morgan et al.
8,359,664 B2 1/2013 Morgan et al.
8,826,927 B1 * 9/2014 Beam ..... E04H 15/001 135/115
2001/0050240 A1 * 12/2001 Reid ..... A63B 57/203 206/315.5
2003/0044575 A1 * 3/2003 Hexels ..... F41H 3/02 428/131
2003/0074825 A1 * 4/2003 Beaty ..... A01M 31/00 43/1
2003/0140956 A1 * 7/2003 Fargason ..... A01M 31/00 114/351
2004/0055068 A1 3/2004 Egnew
2005/0247523 A1 * 11/2005 Sewell ..... B25G 1/04 182/187
2006/0137071 A1 * 6/2006 Rampersad ..... A41D 13/0556 2/24
2007/0084391 A1 * 4/2007 Stevens ..... A41D 13/00 112/475.08
2009/0212051 A1 8/2009 Liu
2009/0242597 A1 10/2009 Morgan et al.
2011/0270299 A1 * 11/2011 Rose ..... A41D 1/08 606/203
2012/0152095 A1 * 6/2012 Youngman ..... D03D 1/0047 89/36.01

FOREIGN PATENT DOCUMENTS

RU 2284002 C2 9/2006
RU 2296942 C1 4/2007
RU 91262 U1 2/2010

* cited by examiner

ADAPTIVE CAMOUFLAGE

CROSS-REFERENCES TO RELATED APPLICATIONS

This application claims the benefit of U.S. Provisional Patent Application No. 61/719,771 entitled REAL-TIME ADAPTIVE CAMOUFLAGE and filed on Oct. 29, 2012 for Kevin Shelley, which is incorporated herein by reference.

FIELD

This invention relates to camouflage and more particularly relates to retaining camouflage material using a frame that may be worn, or attached to an object.

BACKGROUND

Camouflage techniques are used by many people, such as hunters, military personnel, paintball players, and the like. Clothing is available with disruptive patterns that break up a wearer's outline, in colors suitable for blending into many different environments. For additional camouflage, ghillie suits are made with loose strips that resemble foliage and further break up a wearer's outline. Actual foliage may also be used as camouflage. Wearers attach foliage to themselves using retention devices, such as netting or bands on military helmets. Using natural foliage allows camouflage wearers to adapt their camouflage to changing environments.

SUMMARY

Apparatuses are presented for retaining camouflage material. In one embodiment of an apparatus, a frame includes a front surface and a back surface. In a certain embodiment, the frame may be configured to distribute pressure across the back surface from camouflage material retained against the front surface. In a further embodiment, at least one retention device may be coupled to the frame. In some embodiments, the retention device may be configured to retain camouflage material against the front surface of the frame. In certain embodiments, at least one vent opening may be formed in the frame. In further embodiments, a vent opening may include a channel extending between the front surface and the back surface of the frame.

In one embodiment, the frame is sufficiently flexible to conform to a part of a wearer's body. In a further embodiment, the frame may be sufficiently stiff to resist indentation due to pressure from camouflage material. In a certain embodiment, the frame may be integrated with an article of apparel.

In one embodiment, the frame may include two transverse portions and a longitudinal portion. In a certain embodiment, the longitudinal portion may extend between the two transverse portions. In a further embodiment, the retention devices may include two elastic bands. In some embodiments, each elastic band may include a middle portion coupled to one of the two transverse portions of the frame, and end portions extending beyond the frame for fastening around an object.

In another embodiment, the frame may include three sides. In a further embodiment, the at least one retention device may include an elastic band extending along the three sides to form a triangle.

In one embodiment, a retention device may include an elastic band. In a further embodiment, the elastic band may include a front layer and a back layer. In a certain embodiment, the front layer may be coupled to the back layer in at least two positions to form at least one loop.

In one embodiment an array of extension members may extend from the back surface of the frame. In a further embodiment, the extension members may be of a height sufficient to allow airflow between the frame and a wearer. In a certain embodiment, the back surface may include an array of recesses.

In one embodiment, the camouflage material may include natural plant material. In another embodiment, the camouflage material may include artificial plant material. In a further embodiment, the artificial plant material may include a collector for solar energy, motion energy, and\or water.

In one embodiment, a tourniquet may be coupled to the frame. In another embodiment, a pad such as a knee pad and/or an elbow pad may be coupled to the frame.

In one embodiment, a clip may be configured to attach the frame to a webbing strap. In another embodiment, the clip may include a triangular portion rotatably engageable with a triangular opening in the frame.

Systems are presented for retaining camouflage material. In one embodiment of a system, at least one frame may include a front surface and a back surface. In a further embodiment, the frame configured to distribute pressure across the back surface from camouflage material retained against the front surface. In a certain embodiment, two elastic bands may be coupled to the frame. In further embodiments, each elastic band may include a middle portion coupled to the frame for retaining camouflage material against the front surface of the frame, and end portions extending beyond the frame for fastening around an object. In some embodiments, the frame may be sufficiently flexible to conform to part of a wearer's body.

In one embodiment, the system includes comprising a cutting device and at least two additional elastic bands. In a further embodiment, a color of the at least two additional elastic bands may differ from a color of the two elastic bands coupled to the frame.

Methods are presented for retaining camouflage material. In one embodiment, the method includes providing a frame comprising a front surface and a back surface. In a certain embodiment, the frame may be configured to distribute pressure across the back surface from camouflage material retained against the front surface. In a further embodiment, the method may include providing at least one retention device coupled to the frame. In some embodiments, the method may include providing at least one vent opening formed in the frame. In certain embodiments, the vent opening may include a channel extending between the front surface and the back surface of the frame. In one embodiment, the method may include using the retention device to retain camouflage material against the front surface of the frame. In a further embodiment, the method may include wearing the frame. In a certain embodiment, a method may further include adapting to new surroundings by replacing the camouflage material with new camouflage material.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
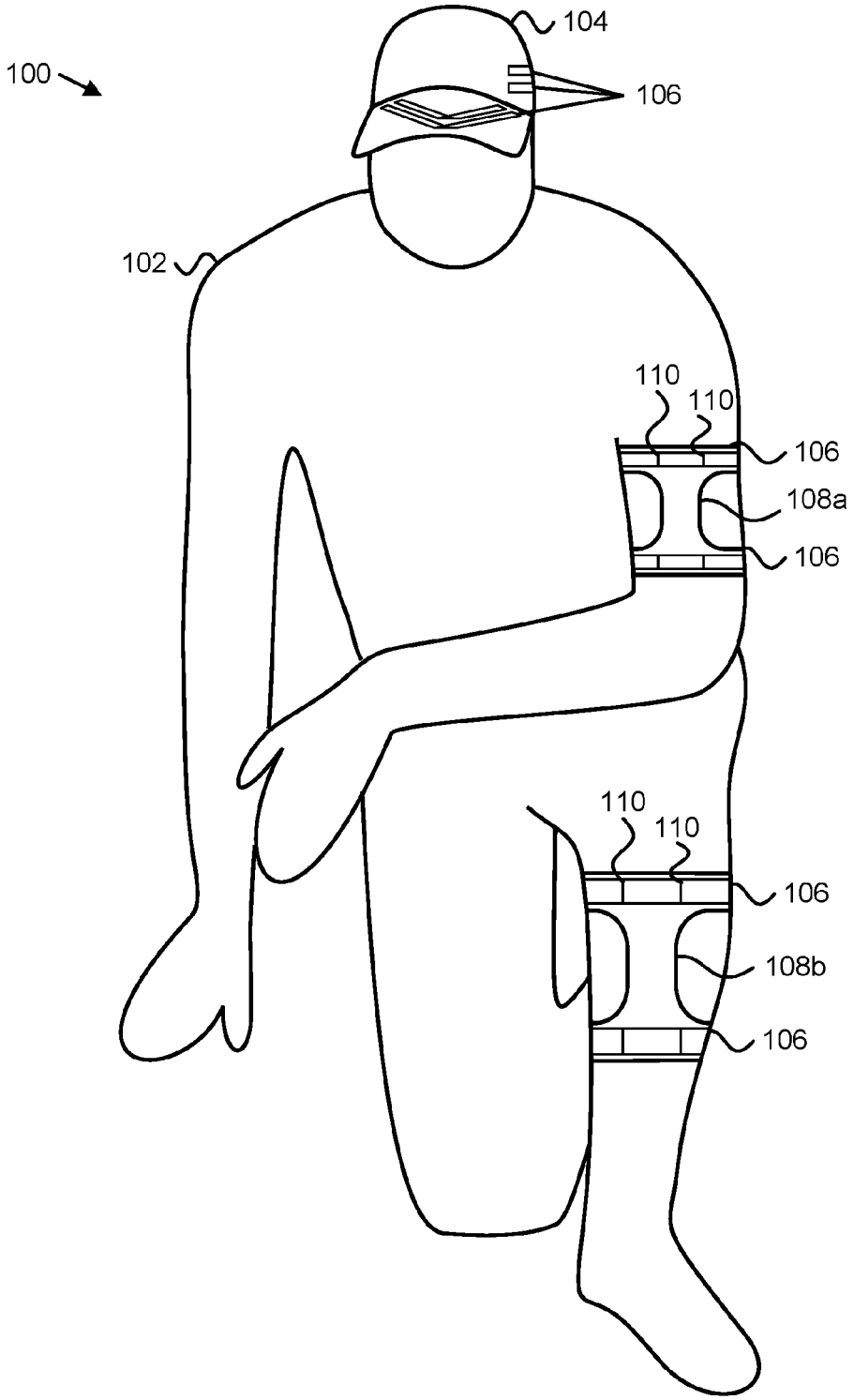
FIG. 1 is a perspective view illustrating one embodiment of a system for retaining camouflage material.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Camouflage clothing alone does not easily adapt to multiple environments. Further, using foliage from a wearer's environment may cause discomfort where rigid foliage or retention devices press into the wearer. The subject matter of the present application has been developed in response to the present state of the art, and in particular, in response to the problems and needs of camouflage users that have not yet been fully solved by currently available products. Accordingly, the subject matter of the present application has been developed to provide an apparatus, system, and method for retaining camouflage material that overcomes many of the shortcomings of the prior art.

FIG. 1 depicts one embodiment of a system 100 for retaining camouflage material, disposed on a wearer 102. In the depicted embodiment, the system 100 includes frames 108 and retention devices 106 coupled to the frames 108. In a certain embodiment, the frames 108 may include an arm frame 108*a*, a leg frame 108*b*, and one or more head frames (not shown) disposed within a hat 104.

In one embodiment, the wearer 102 may use camouflage for hunting. In another embodiment, the wearer 102 may use camouflage for military applications. In a different embodiment, the wearer 102 may use camouflage for paintball or other outdoor games or sports. In a further embodiment, the wearer 102 may use camouflage for entertainment, pranks, costumes, dancing, playing tricks on friends, or the like. In various embodiments, the wearer 102 may use camouflage for a variety of activities. Although the wearer 102 is shown as a person in FIG. 1, in another embodiment, a system such as system 100 may be used to retain camouflage material for an animal or an object. For example, a frame 108 and retention devices 106 may be used to camouflage a police or military dog, a pack animal, a vehicle, a wheelchair, a rifle or bow, or the like.

In the depicted embodiment of the system 100, the wearer 102 may use one or more or the retention devices 106 to secure camouflage material against the front surface of a frame 108. In various embodiments, camouflage material may refer to any material that is useful for concealment. For example, in certain embodiments, camouflage material may include natural plant material, such as grasses, foliage, leaves, twigs, branches, or the like. Using natural vegetation indigenous to the wearer's 102 surroundings as camouflage material may allow the wearer 102 to generally resemble his or her background, and may also allow a wearer 102 to adapt to new or changing surroundings in real time, by replacing the camouflage material with new camouflage material suitable to the new surroundings. For example, in a certain embodiment, as a wearer 102 moves from a forest environment to a meadow environment while hunting, the wearer 102 may remove camouflage material including branches and leaves of forest trees from the frame 108, and replace it with camouflage material including meadow grasses.

In another embodiment, camouflage material may include artificial plant material resembling grasses, foliage, leaves, twigs, branches, or the like, so that the wearer 102 leaves no pruning traces. In some embodiments, camouflage material may include other materials that provide protective coloration or patterns, break up the outline of a wearer 102 or other object, dazzle an observer, or the like. For example, in one embodiment, the camouflage material may include fabric material such as netting, camouflage fabric, colored fabric, or the like. In another embodiment, the camouflage material may include multiple strips or chunks of various material that break up a wearer's outline.

In one embodiment, the wearer 102 may use camouflage material in natural colors or patterns for concealment in the outdoors. In another embodiment, a wearer 102 may use camouflage material in colors or patterns other than those found in nature, for concealment in a different environment. For example, a wearer 102 may attend a themed event where the theme is a brightly colored fantasy world, and may use correspondingly brightly colored camouflage material to blend in to (or suddenly appear out of) the background. It is clear, in view of this disclosure, that many types of camouflage material may be suitable for different types of surroundings.

In various embodiments, a wearer 102 may use the system 100 with additional camouflage devices such as camouflage clothing, a ghillie suit, a duck blind, or the like. In another embodiment, however, the wearer 102 may use the system 100 without additional camouflage devices. In a further embodiment, if the wearer 102 assumes a tucked position as shown, camouflage material secured to the wearer's 102 arm, leg, and head, may align to fully camouflage the wearer 102, even without additional camouflage devices. In another embodiment, a similar tucked position may be adapted to align camouflage along the body of a non-human wearer 102, such as a police dog, or the like. A wearer 102 using the system 100 for camouflage in a tucked position may be unhidden while running or walking, but may quickly become effectively camouflaged simply by assuming the tucked position.

In various embodiments, a system 100 for retaining camouflage material may include one or more frames 108. In the depicted embodiment, the system 100 includes an arm frame 108*a*, a leg frame 108*b*, and one or more head frames disposed within a hat 104. In one embodiment, the system 100 may include one or more additional frames for use on a wearer's 102 chest, back, both arms and legs, or the like. In a further embodiment, the system 100 may include frames 108 for mounting to objects such as ladders, wheelchairs, vehicles, bows, rifles, or the like. In another embodiment, the system 100 may include fewer frames 108 than are shown in FIG. 1. For example, a wearer 102 may omit the leg frame 108*b* and still obtain the benefits of securing camouflage material to his or her upper body. In light of this disclosure, it is clear that many configurations of frames 108 and camouflage material are possible.

In general, using frames to provide camouflage may make a camouflage system 100 easy to clean. For example, in some embodiments, a user may remove foliage from a frame 108 more easily than from a ghillie suit, which may include tangled foliage. In another embodiment, the system 100 may provide a weight advantage over a ghillie suit, because a wearer 102 using indigenous plants for camouflage material may carry the weight of the frames only, until he or she needs to add camouflage material to the frames. Thus, a user of the system 100 may be more lightweight and mobile than a user of a ghillie suit. A user of the system 100 may also, carry less water than a user of a ghillie suit, due to the reduced weight and heat associated with using indigenous camouflage material.

In the depicted embodiment, each frame 108 includes a front surface and a back surface. In certain embodiments, a frame 108 may be configured to distribute pressure across the back surface from camouflage material retained against the front surface. In various embodiments, a frame 108 may be positioned between camouflage material and a wearer 102 or other object, and may, by distributing pressure, act as a guard to protect the wearer 102 or other object from discomfort or damage that the camouflage material might otherwise cause. For example, the frames 108 may prevent discomfort that the wearer 102 might experience if camouflage material such as branches, twigs, leaves, or the like were secured to the wearer 102 without frames 108, or may keep an object from being scratched by harder camouflage material such as branches.

As used herein, terms such as "front," "back," "up," "down," "upper," "lower," "horizontal," "vertical," "left," "right," and the like, refer to a view where camouflage material conceals a wearer 102 or other object. Thus, the "front" surface of the frame 108 is the surface against which camouflage material is retained, and the "back" surface is an opposite surface of the frame 108, which may be positioned against a wearer 102 or other object. These terms are used, where applicable, to provide some clarity of description when dealing with relative relationships. However, these terms are not intended to imply absolute relationships, positions, and/or orientations. For example, with respect to an object, an "upper" surface can become a "lower" surface simply by turning the object over. Nevertheless, it is still the same object. Similarly, a wearer 102 may reverse a frame 108 to secure camouflage material behind his or her body, but the surface positioned against the wearer may still be described as the "back surface."

In various embodiments, a frame 108 may be made of various materials that allow the frame to distribute pressure. Some materials may distribute pressure more evenly than other materials. Thus, in certain embodiments, distributing pressure from the front surface across the back surface may refer to distributing pressure evenly or unevenly, but may indicate that the force applied to a smaller area of the front surface (such as the area in contact with a branch or twig), is applied to a larger area of the wearer 102 or other object by the back surface.

For example, in one embodiment, the frame 108 may be made of a material that is sufficiently stiff to resist indentation when pressure from camouflage material is applied to the front surface. The back surface may also be contoured to fit a wearer 102 or other object. This material may be sufficiently rigid to distribute pressure by transmitting force from a small area where the front surface contacts the camouflage material to a larger area where the back surface contacts the wearer 102, thus preventing discomfort. However, if the back surface is inaccurately contoured to the wearer 102, a stiff or rigid frame 108 may itself cause discomfort. Thus, in another embodiment, the frame may 108 may be made of material that is sufficiently flexible to conform to a part of a wearer's 102 body. However, if the frame 108 is very flexible, the back surface may deform where the front surface is deformed, and the frame may not distribute pressure well. Thus, in certain embodiments, the frame 108 is made of a material that provides a balance of flexibility and stiffness. Particular materials that balance flexibility and stiffness are discussed below with regard to the frame 200 of FIGS. 2 and 3. However, in various embodiments, various other materials may also provide a suitable balance of flexibility and stiffness.

In another embodiment, a frame 108 may be made of spongy or springy material that compresses to spread force applied to the front surface over a larger area. For example, in one embodiment, the frame 108 may include foam padding material. In one embodiment, the frame 108 is formed as a single piece, such as a molded piece. In another embodiment, the frame 108 may include multiple pieces or multiple materials. For example, in one embodiment, a frame 108 may include a stiff or rigid front surface, and a padded or flexible back surface, such as a breathable foam or cloth. In another embodiment, a frame 108 may include a stiff or strong honeycomb core, such as a fiberglass, carbon fiber, metal mesh, aramid core, or the like, disposed within a more flexible material such as resin, plastic, rubber, or the like. Using a thin honey comb core instead of molding a frame 200 out of a single material may, in some embodiments, allow the thickness of the frame 300 to be reduced by approximately half, while still allowing the frame 200 to distribute pressure. In some embodiments a frame 108 may include smaller pieces of stiff material flexibly joined together. For example, a frame 108 may include a mesh of linked metal rings, or an array of small linked metal plates. Many materials are clear, in view of this disclosure, that may be suitable for use in a frame 108.

In certain embodiments, a frame 108 may be integrated with an article of apparel. For example, in the depicted embodiment, the retention devices 106 on the side of the hat 104 are coupled to a head frame 108 disposed inside the hat 104. The head frame 108 may be a rectangular insert that adds stiffness to the side of the hat 104 to distribute pressure from camouflage material retained against the hat 104. Although FIG. 1 depicts the hat 104 as a baseball cap, in another embodiment, the hat 104 may be another type of head covering, such as a beanie, a bandana, a helmet, or the like. In some embodiments, frames 108 may be integrated with articles of apparel other than hats 104, such as military uniforms, shirts, pants, jackets, or the like. For example, in another embodiment, the frame 108 may be a padded region integrated into a shirt, or pants. As a further example, certain sports garments are available with integrated regions of honeycomb foam padding, which could be used as frames 108 for retaining camouflage. In a further embodiment, padding in certain sports garments is broken up into blocks or chunks, but several chunks joined by the garment may act as a frame 108, with the gaps between blocks or chunks forming openings that provide ventilation. In general, whether integrated with an article of apparel or not, many materials are available to provide a protective frame 108 which may include further attributes for comfort, such as a comfortable contour, comfortable padding, or comfortable ventilation.

In some embodiments, if the frame 108 is integrated with an article of apparel, the article of apparel may be the front surface or back surface of the frame 108. For example, if the frame 108 includes a padded region inside a sports garment, the garment may be the front surface of the frame 108. Alternatively, if the frame 108 includes an elbow guard, knee guard, or the like, attached to the outside of a garment, the garment may be the back surface of the frame 108.

In a further embodiment, a frame 108 and an article of apparel could be configured as complementary portions of a camouflage system. For example, in one embodiment, an article of apparel may include buckles or other fasteners for attaching a frame 108, as well as straps, elastic bands, or the like, for cinching the frame against the wearer's 102 body. In a further embodiment, apparel may include reinforced portions, such as leather patches on areas where a frame 108 may be laced, and splashes of camouflage patterns printed on areas further away from where a frame 108 might be placed, for additional camouflage In one embodiment, at least one retention device 106 may be coupled to a frame 108. In a further embodiment, the retention device (or devices) 106 may be configured to retain camouflage material against the front surface of the frame 108. In various embodiments, a retention device 106 may refer to any device suitable for retaining camouflage material against the frames 108. For example, in certain embodiments, the retention device 106 used to retain camouflage material against the front of a frame 108 may include an elastic band, an elastic sheet, elastic netting or mesh, a band of fabric that can be cinched to secure camouflage material, a clip, a loop, a strap that may be fastened with a snap, button, buckle, or other fastener to form a loop, netting through which camouflage material may be interwoven, or the like. It is clear, in light of this disclosure, that many types of retention devices 106 are suitable for use with the system 100. In further embodiments, a retention device 106 configured to retain camouflage material may also be suitably configured to retain other material. In a suitably adapted embodiment, any material which may cause discomfort due to pressure when worn may be retained against a frame 108 using a retaining device 106. For example, in one embodiment, brightly colored material may be used for a theatrical costume instead of camouflage material.

In one embodiment, the retention devices 106 may be treated for durability and/or tack. For example, a tacky, sticky, or rubbery gel may be used, in some embodiments, to coat all surfaces of a retention device 106 or may be applied to a retention device 106 in a pattern. Such surface treatments of the retention devices 106 may, in certain embodiments, aid in retaining camouflage material by increasing the contact surface area or tackiness of a retention device 106.

In some embodiments, similar retention devices 106 may be used to retain camouflage material against an object without using a frame 108. For example, in the depicted embodiment, elastic bands sewn to the brim of the hat 104 act as retention devices 106 to retain camouflage material against the hat 104. No frame 108 is used on the brim of the hat 104, because the brim of the hat 104 is sufficiently stiff to support camouflage material away from a wearer's 102 head without adding a frame 108.

In the depicted embodiment, the retention devices 106 are elastic bands that are coupled to the frames 108. In various embodiments, an elastic band may refer to a cord, tape, fabric, or the like, that is woven with (or otherwise includes) strips of rubber or another elastomer. Common widths of elastic bands such as one inch or half inch elastic bands may be suitable as retention devices 106 in a certain embodiment, but in another embodiment, another width of elastic band may be used. The elastic bands may be stretched away from the frames 108 to form a gap for inserting camouflage material, and may be released to retain the camouflage material against the front surfaces of the frames 108. The elastic bands for the arm and leg frames 108*a*, 108*b* may extend around the wearer's 102 arm or leg to secure the frames 108 to the wearer 102.

In one embodiment, elastic bands may be coupled to a frame 108 by threading the elastic bands through openings molded into the frame 108. In another embodiment, the retention devices 106 may attach to the frame 108 using snaps, pins, or other fasteners. In certain embodiments, the frame 108 is integrated with an article of apparel or other fabric, and the retention devices 106 may be sewn onto the fabric. In light of this disclosure, it is clear that the retention devices 106 may be coupled to the frames 108 in a variety of ways.

In the depicted embodiment, two elastic bands are used as retention devices 106 for each frame 108. Using two or more elastic bands as retention devices 106 for each frame 108 allows a user to secure camouflage material to the frame 108 at two or more points, thus preventing the camouflage material from rotating or moving excessively relative to the frame 108. For example, a branch held against a frame 108 at two points may not move as easily as a branch held against the frame at one point. However, in some embodiments, one elastic band may be used as a retention device 106. For example, smaller natural plant materials, such as grasses, leaves, or the like, may be held in place by one elastic band, or by another retention device 106 as described above. In one embodiment, two elastic bands may be parallel to each other. However, in another embodiment, two elastic bands may be angled with respect to each other, but may still be used to retain a branch or other camouflage material at two separate points.

In the depicted embodiment, with two parallel, horizontal elastic bands, camouflage material may be retained vertically or at small angles from the vertical by securing it between the frame 108 and both elastic bands, so that the camouflage material runs vertically along the wearer's 102 arm or leg. Camouflage material may also be retained at larger angles from the vertical by securing it under only one elastic band.

In the depicted embodiment, each elastic band includes a middle portion coupled to the frame 108 and end portions extending beyond the frame 108. In a certain embodiment, the middle portion may be coupled to the frame 108 for retaining camouflage material against the front surface of the frame 108. In a further embodiment, the end portions may extend beyond the frame 108 for fastening around an object, such as a wearer's head, limb, or other body part, or a part of a wheelchair, bow, rifle, paintball gun, or the like. In another embodiment, however, the frame 108 may attachable to an object with an adhesive, or the like, and the elastic band may not include end portions that extend beyond the frame 108. In one embodiment, the end portions of an elastic band may meet, forming a loop. For example, an elastic loop could be sized to fit around the object that is to be camouflaged.

In another embodiment, the end portions of an elastic band may include one or more fasteners, and may fasten together to fit around the object that is to be camouflaged. For example, in one embodiment, one end portion of an elastic band may be attached to the female portion of a side-release plastic buckle, and another end portion may be threaded through the male portion. In a further embodiment, a fastener, such as the male portion of a side-release plastic buckle, may be removable for threading the elastic band through openings in the frame 108. In a certain embodiment, the fasteners may be contoured side-release plastic buckles. In various other embodiments, the fasteners for the end portions of an elastic band may include fastening devices such as straight side-release plastic buckles, snaps, hook and loop fasteners, double D-ring fasteners, or the like. In another embodiment, the end portions may be fastened by knotting them together, so that no fasteners are used. In embodiments where silent operation is desired, such as when hunting, rubberized buckles may be used as fasteners. In light of this disclosure, it is clear that many types of fasteners and methods of fastening may be used with elastic bands or similar retention devices 106.

In one embodiment, an elastic band used as a retention device 106 may include a front layer and a back layer. In a further embodiment, the front layer may be coupled to the back layer in two or more positions 110 to form one or more loops. For example, in one embodiment, two layers of elastic band material may be sewn together at intervals (e.g., at positions 110) to form a series of loops, and camouflage material may be secured in the loops between the two layers. In another embodiment, three or more layers of elastic band material may be used to form loops. In certain embodiments, loops in an elastic band or other retention device 106 facilitate securing smaller camouflage material, such as grasses, leaves, or the like in the smaller spaces of the loops, as compared to the larger space between the retention device 106 and the frame 108, which might more easily be used to secure larger camouflage material, such as branches and the like.

In certain embodiments, loop widths may be configured to easily admit a user's fingers with camouflage material. For example, in various embodiments, a loop width may be one and one half inches, two inches, three inches, or the like. However, in another embodiment, a loop width may be selected based on other criteria. For example, a much smaller loop width may be useful for securely retaining small twigs.

In various embodiments, an elastic band may include knots, braids, twists, folds, varying elastic widths, or the like, which may provide easy access to the loops. For example, in one embodiment a twisted layer of elastic band material may allow a user to easily separate two sides of a loop. In various other embodiments, elastic might be gathered or bunched between seams, or crimped between loops to allow a user's fingers to easily engage the loops. In light of this disclosure, it is clear that many configurations are possible for the loops formed by layers of an elastic band.

In the depicted embodiment, the loops are formed by layers of an elastic band, but in other embodiments, loops may be formed in other ways. For example, in one embodiment, loops may be cells of an elastic mesh. In another embodiment, a loop may be formed by tying elastic material in a knot. In a further embodiment, additional loops may be formed by sewing the elastic band to itself across a certain distance. In light of this disclosure, it is clear that loops may be formed in a variety of ways.

In certain embodiments, foliage or other camouflage material secured between a frame 108 and an elastic band may obscure the wearer and the frame 108, but leave the elastic band itself un-camouflaged. Accordingly, in further embodiments, a system 100 including two elastic bands coupled to a frame 108 may include at least two additional elastic bands of a different color. In certain embodiments, then, elastic bands may be selectable by a wearer from a plurality of elastic bands, of a plurality of colors. For example, a black elastic band may be selected for night camouflage, or a tan elastic band may be selected for desert camouflage. Various colors or patterns may be used in various embodiments of elastic bands.

In one embodiment, a fastener may be non-removably affixed to one end portion of the elastic band. For example, in a certain embodiment, the elastic band forms a small loop that extends through an opening at the end of a buckle, and is sewn shut. However, in some embodiments, changing to an elastic band of a different color may involve sliding the elastic band through narrow openings in a frame 108, so a corresponding fastener on the other end portion of the elastic band may be removably attached. For example, in the depicted embodiment, the non-removable fastener is one mating portion of a side-release buckle, but the corresponding mating portion is removed from the other end of the elastic band, and is not depicted. Thus, in one embodiment, an elastic band used as a retention device 106 may have stops disposed along the elastic band. In certain embodiments, stops may prevent an elastic band from sliding through openings in the frame 108, or through openings in fasteners during normal operation. However, in some embodiments, the stops may be configured so that the elastic band may be removed from the frame 108 or fasteners.

In a further embodiment, stops may allow the elastic band to slide through openings in the frames 108 and in the buckles or other fasteners under a certain amount of tension, but may prevent it from sliding under the tension normally required to retain camouflage material. By preventing sliding, the stops keep the elastic band in place and remove the need for locking pieces to be used with side-release buckles.

In one embodiment, stops are formed along with loops; a second layer of elastic band material is sewn onto the elastic band to form the loops, and this second layer is folded under itself at the ends, to avoid a raw fabric edge and to increase the thickness of the material, thus creating stops. In a further embodiment, additional stops are formed by sewing the elastic band to itself across a small distance, so the stop is a small loop. In such an embodiment, the stops are formed of the same material as the elastic band, allowing them to deform under tension to go through openings when the elastic bands are changed. In another embodiment, the stops may be formed in another way. For example, the stops may be pinned onto the elastic band, and removed before the elastic band is changed. In various embodiments, stops might be formed using brads, clips, twists, folds, or the like to halt motion from pressures exerted during functional use, but allow passage of the elastic band through buckles, bends, and loops when purposely weaving or unweaving the elastic band through the apparatus with slightly increased pressure. In light of this disclosure, it is clear that stops for an elastic band may be formed in many ways.

In some embodiments, the system 100 for retaining camouflage may include additional components for use as accessories to the frames 108 and retaining devices 106. For example, in one embodiment, the system 100 may include a cutting device and one or more holsters. In further embodiments, the system 100 may include additional components coupled to the frames 108, such as a tourniquet, an elbow pad, or a knee pad.

In certain embodiments, a cutting device may be used to cut branches, foliage, and the like off of plants for use as camouflage material. In various embodiments the cutting device may be a pair of scissors, such as trauma shears, a knife, a multi-tool, a custom-designed cutting tool, or the like. In further embodiments, a blade or blades of the cutting device may be anodized black to reduce reflections. In light of this disclosure, it is clear that many types of cutting device may be used in various embodiments of the system 100.

A holster or holsters may be used in some embodiments for storage purposes. For example, one holster may store the cutting device, and another holster may store additional elastic bands of different colors. In a further embodiment, a holster may include loops that hold a frame or frames 108 when not in use. In various embodiments, a holster may be worn at the belt, fastened around the leg, or attached to the wearer 102 in various other ways. In various embodiments, a holster may be sewn from ballistic nylon, injection molded, made of leather or made of various other materials.

The position of the frame 108 on a wearer's 102 arm or leg suggests additional components that may be coupled to a frame. For example, in one embodiment, a tourniquet may be coupled to a frame 108. An integrated tourniquet may be useful for military users who often use camouflage, and who may need to rapidly stop bleeding if wounded. In a further embodiment, the tourniquet may be a band that attaches the frame 108 to an arm or a leg, but that can be cinched or twisted to cut off blood flow if the arm or leg is wounded.

Similarly, in another embodiment, a pad, such as an elbow pad or knee pad may be coupled to a frame 108. Integrating the frame with an elbow pad or knee pad may provide better positioning for both the pad and the frame 108 as compared to separate pads and frames 108. Additionally, materials or designs that allow a frame 108 to be comfortably worn may also be used to create more comfortable elbow or knee pads. In a certain embodiment, a tourniquet and a knee or elbow pad may be coupled to a frame 108. It should also be noted that an integrated tourniquet may be useful in connection with an elbow or knee pad, whether or not a frame 108 is included.

Figure 2:
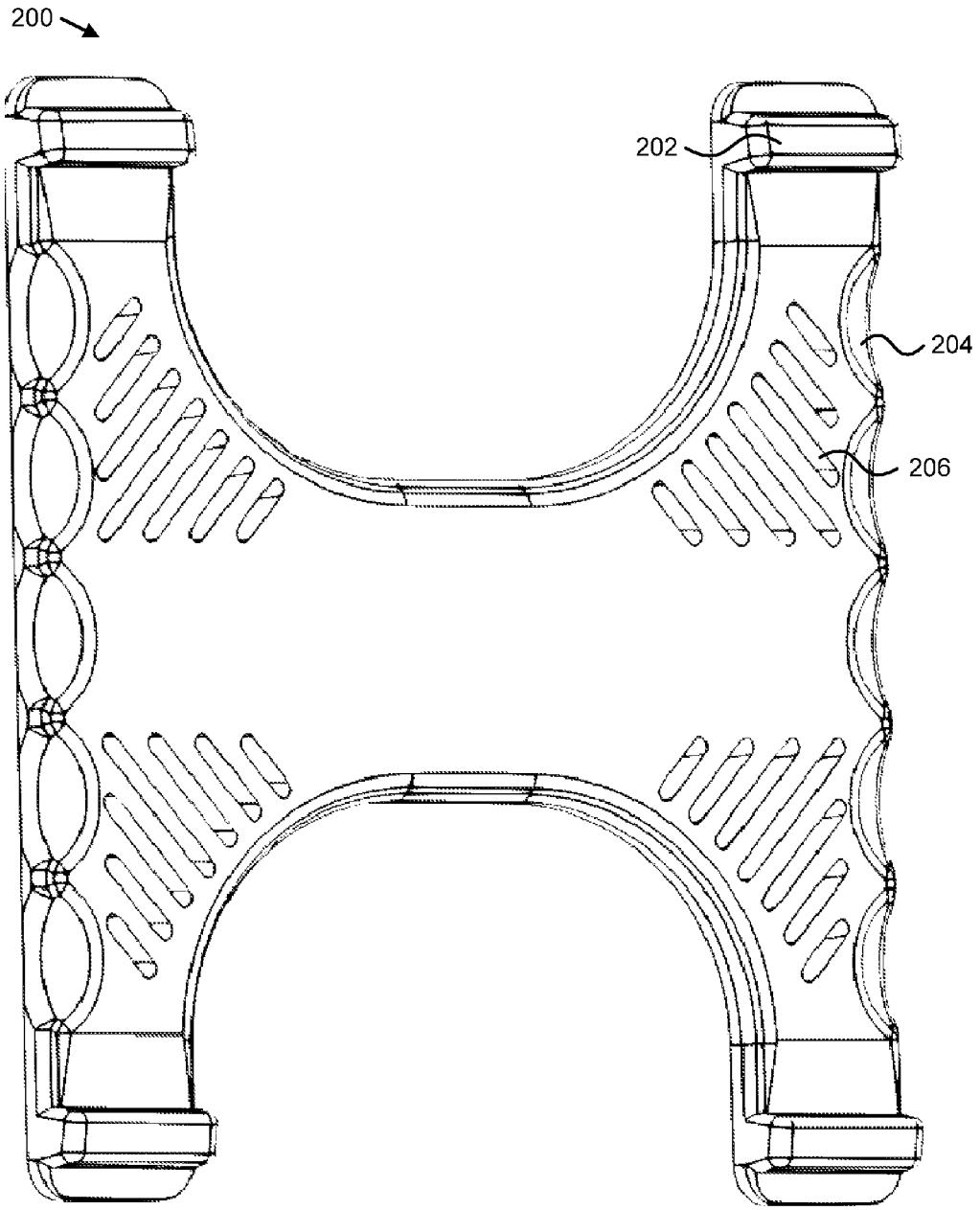
FIG. 2 is a front perspective view illustrating one embodiment of a frame for retaining camouflage material.

FIG. 2 depicts one embodiment of a frame 200 for retaining camouflage material, as viewed from the front. The frame 200 may be substantially similar to the frame 108 described above with regard to FIG. 1. In general, as described above, retention devices may be used to secure camouflage material to the front (the depicted surface) of the frame 200. Although not shown in FIG. 2, various retention devices including elastic bands suitable for use with the frame 200 are described above with regard to FIG. 1. In the depicted embodiment, the frame 200 includes loops 202 for elastic bands, indentations 204, and vent openings 206.

In one embodiment, one or more loops 202 are formed in the frame 200 for receiving elastic bands or other retention devices. In the depicted embodiment, the frame 200 is molded with raised portions, and the back of the mold is configured to form a slot underneath the raised portions, forming loops 202. Elastic bands may then be threaded along the front surface of the frame 200 and under the loops 202, which hold the elastic bands in place. In another embodiment, loops 202 for receiving elastic bands or other retention devices may be openings molded or cut through the frame 200, so that elastic bands can be threaded from the front of the frame 200 to the back. In a further embodiment, loops 202 may be formed as part of the frame 200, or may be attached to the frame 200 in another way.

In one embodiment, one or more indentations 204 are formed in the front surface of the frame 200. In a further embodiment, the indentations 204 may be located at an edge of the frame 200. Thus, when elastic bands are coupled to the frame 200 through the loops 202, the indentations may be positioned between the elastic bands and the frame 200. In the depicted embodiment, the indentations 204 facilitate slipping objects between the elastic bands and the frame 200. For example, a wearer may slip his or her finger into an indentation 204 to stretch an elastic band away from the frame 200, to insert large camouflage material such as branches. Indentations 204 in a front surface of the frame 200, in a further embodiment, may also keep camouflage material in place by preventing it from rolling or sliding across the front of the frame 200.

In one embodiment, the frame 200 may include at least one vent opening 206. Vent openings 206 may be formed in the frame 200, in various embodiments, to allow air to flow between the front and back surfaces of the frame 200. Thus, in certain embodiments, the vent openings 206 may be channels that extend or communicate between the front and back surfaces of the frame 200. In some embodiments, the vent openings 206 provide airflow to prevent discomfort from heat, moisture, sweat buildup, or the like. The vent openings 206, in certain embodiments, may cooperate with the extension members described below to allow airflow to flow freely around the entire frame 200 to dry and cool it.

In certain embodiments, the vent openings 206 may be disposed at positions within the frame 200 that provide flexibility for the frame 200 to conform to a wearer's limbs. For example, in the depicted embodiment, the frame 200 includes two transverse portions, which may bend to conform to a wearer's limbs, and a longitudinal portion extending between the two transverse portions, so that the frame forms an I (or H) shape. Each elastic band may include a middle portion coupled to one of the two transverse portions of the frame 200, and end portions that extend beyond the frame 200 for fastening to a wearer or other object. When fastened in this manner, the transverse portions 218 of the I-shaped frame 200 bend to curve with the radius of the wearer's limb, and the longitudinal portion of the frame 200 extends along the wearer's limb. To provide flexibility, the vent openings 206 are be disposed near intersections of the transverse portions and the longitudinal portion of the frame 200. In another embodiment, the vent openings 206 may be disposed across the full length of the frame 200, thus providing additional heat venting and water wicking, while still allowing foliage to be inserted without catching on, or interfering with, the vent openings 208, and still allowing the frame 200 to provide protection to the wearer against pressure from camouflage material. In light of this disclosure, it is clear that because the vent openings 206 provide both ventilation and flexibility, many different configurations of vent openings 206 may be used in the various embodiments of the frame 200.

Although the frame 200 is in an I shape in the depicted embodiment, the frame 200 may have another shape in another embodiment. For example, in one embodiment, an X-shaped frame 200 may be used for the back or chest of a wearer. Alternatively, in another embodiment, a wearer may use two H-shaped frames 200 attached to each other for the back and chest. In light of this disclosure, it is clear that many shapes may be used, depending on where the frame is to be worn.

In one embodiment, the I-shaped frame 200 is an arm guard, approximately 5.5 inches in height. The 5.5 inch height allows the arm guard to fit above a wearer's elbow but below the armpit, even if a bulky jacket is worn. In another embodiment, the I-shaped frame 200 is a leg guard, approximately 7 inches in height. The 7 inch height allows the leg guard to fit below the wearer's knee, but above the top of a boot. In a further embodiment, a wearer may adjust the longitudinal portion to change the height of the I-shaped frame 200. In another embodiment, the frame 200 is a rectangular insert for the side of a hat, and retention devices 206 are attached on the outside of the hat. In a certain embodiment, a frame 200 may attach to a bow or rifle, and may be V-shaped to hold camouflage to either side of the weapon without obstructing the shooter's view. It is clear in light of this disclosure that frames 200 may have various shapes and sizes in various embodiments.

In a certain embodiment, the front surface of the frame 200 may include an anti-reflective finish. For example, a mold for the frame 200 may be roughened by sandblasting, with acid, or by other methods to provide a matte anti-reflective finish for the front surface when the frame 200 is unmolded. An anti-reflective surface prevents reflections from the frame 200 from revealing a camouflaged wearer's position. In another embodiment, the frame 200 may be frequently obscured by camouflage material secured between the frame 200 and a retention device, and an anti-reflective finish might not be provided.

In another embodiment, a camouflage pattern may be printed on the front surface of the frame 200. For example, in one embodiment, a camouflage pattern may be printed on the frame 200 using jets of ink. In a certain embodiment, a camouflage pattern may be printed on the frame 200 using hydrographics, or water transfer printing. In a further embodiment, a clear coating may prevent a printed camouflage pattern from being scratched or scraped. In a further embodiment, the material of the frame 200 may be chosen to provide a desired base color for a camouflage print.

In one embodiment, a contoured plate or flexible skin may be adhered, snapped on, stretched over, or otherwise attached to the front of the frame 200. For example, removable coverings in varying colors or prints could be removably attached the front of the frame 200 to allow a wearer to easily change the appearance of the frame 200. In certain embodiments, a skin or plate with a camouflage pattern may cover a frame 200 made from a material that would not otherwise easily accept a printed camouflage pattern. Using a skin may provide camouflage if camouflage material is lost, leaving the frames 200 uncovered.

In one embodiment, the edges of a skin may be molded to fit over the edges of a frame 200. In another embodiment, the retention devices used for camouflage material may also attach a skin or other covering to a frame 200. For example, in one embodiment, a skin may be lipped under elastic bands that are used as retention devices, and held in place by the pressure of the elastic bands and/or camouflage material. In certain embodiments, a skin may include openings corresponding to vent openings 206 in the frame 200, so that the skin does not block the vent openings 206. In various embodiments, a skin or other covering for a frame 200 may include various materials, such as fabric, flexible plastic, or the like.

In a certain embodiment, where fabric material is used as camouflage material, the front of the frame 200 may include light emitting devices such as light emitting diodes, light bulbs, or the like, which are configured to illuminate the fabric material. For example, light emitting diodes may be embedded in the front of the frame 200, with a battery pack provided. Illumination may change the perceived color of the fabric material for better camouflage, so in further embodiments, the fabric material may be illuminated with light of a color selectable by the wearer from a plurality of colors. For example, a neutral colored fabric may be used as camouflage in both forest and sand environments by selecting green or brown illumination, respectively. Alternatively, in various other embodiments, the material itself may change color without illumination. For example, electronic paper that colors without a backlight, or material with heat-sensitive dyes and a power source to change the temperature of the material could be used as camouflage material. In a further embodiment, the frame 200 may receive a wireless signal encoding color, pattern, pre-set, or photographic image information for the camouflage material. For example, in one embodiment, a wearer might control the camouflage pattern from a phone, wirelessly coupled to the frame 200.

Figure 3:
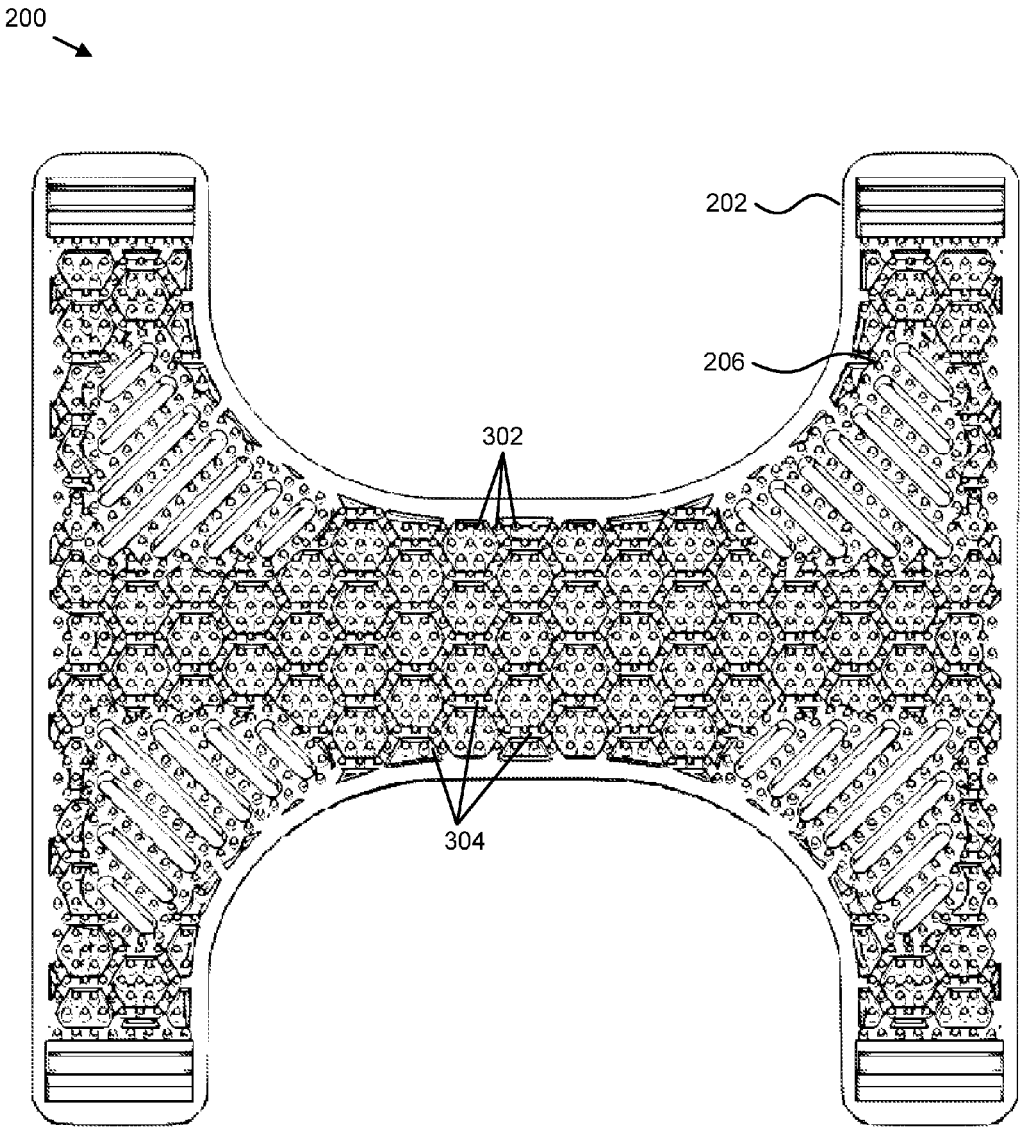
FIG. 3 is a back perspective view further illustrating the frame of FIG. 2.

FIG. 3 depicts the frame 200 of FIG. 2, as viewed from the back. The back view of the frame 200 includes the reverse sides of the loops 202 and vent openings 206 described above with regard to FIG. 2. In the depicted embodiment, the frame 200 includes an array of extension members 302, and an array of recesses 304.

In one embodiment, an array of extension members 302 extends from the back (the depicted surface) of the frame 200. In a further embodiment, the extension members 302 are of a height sufficient to allow airflow between the frame 200 and a wearer. In this configuration, pressure from the frame 200 and camouflage material may be distributed across the array of extension members 302. The extension members 302, in a certain embodiment, cooperate with the vent openings 206 to allow airflow both through and under the frame 200, preventing discomfort and sweat buildup. In a further embodiment, some extension members 302 may be disposed between vent openings 206. For example, in the depicted embodiment, the frame 200 includes elongate vent openings 206 in alternating sequence with rows of extension members 302. In addition to allowing airflow, extension members 302 may, in certain embodiments, provide a comfortable and/or non-slip surface for a wearer of the frame 200.

In the depicted embodiment, the extension members 302 include pins, of an approximately cylindrical or frustoconical shape, and of the same material as the rest of the frame 200. In various embodiments, the pins may have a flat tip, a rounded tip for comfort, or may include other shapes. In a certain embodiment, the pins may have a diameter of approximately 1 mm and a height of approximately 3 mm, and may be disposed in an array where each pin is approximately 2 to 3 mm apart from an adjacent pin. In another embodiment, the shape and/or dimensions of the pins may vary while still effectively distributing pressure and allowing airflow. Pin-shaped extension members 302 may also provide sufficient friction to prevent the frame 200 from slipping when worn. In yet another embodiment, the extension members 302 may include blocks or other shapes in an array allowing airflow between the frame 200 and a wearer. In light of this disclosure, appropriate dimensions for extension members 302, depending on the material used, may be determined without undue experimentation.

Although the extension members 302 and vent openings 206 are disclosed herein for use with an apparatus or system for retaining camouflage, it should be noted that the extension members 302 and vent openings 206 may provide similar benefits for other devices. For example, using extension members 302 and vent openings 206 may make belts, holsters, shoulder pads, knee pads, elbow pads, backpack straps, back supports, or many other devices more breathable and comfortable In one embodiment, the back surface of the frame 200 may also include an array of recesses 304. Recesses 304 in the back surface of the frame 200 may reduce the weight of the frame 200, in some embodiments, as well as the amount of material needed, while still providing sufficient resilience against pressure from camouflage material that might otherwise be uncomfortable, such as branches, foliage, and the like. In a further embodiment, the array of recesses 304 may include one or more hexagonal recesses 304. Hexagonal recesses 304 in an array on the back surface of the frame 200 leave raised areas in the spaces between the array, in a honeycomb pattern. This honeycomb pattern of raised areas, in some embodiments, may form a support skeleton for the frame 200, providing resilience in multiple directions.

In some embodiments, the multiple features of the frame 200, including pin-shaped extension members 302 and recesses 304 in a hexagonal skeleton, may require extended amounts of time for mold tooling. In the depicted embodiment, the mold tooling time is reduced by first drilling a pattern of holes in the mold corresponding to the pins, then using a three-dimensional model to cut the honeycomb pattern between the recesses 304 as well as the rest of the mold. Thus, instead of using a small tool to cut the mold in one pass, a larger or courser tool may be used to save time on a first pass, drilling holes for the pins, and then the smaller tool could be used to complete the details such as the honeycomb pattern on a second pass. Drilling holes for the pins first, in some embodiments, may reduce tooling time by approximately an order of magnitude compared to using one tool to cut all the features of the mold.

In a certain embodiment, manufacturing time may also be saved by using one mold tool to create several frames for the system 100 of FIG. 1, simultaneously. For example, an arm frame, a leg frame, and one or more head frames (for different sides of the head) may be made at once or separately, using the same mold. In further embodiments, recesses 304 in the frame 200 reduce the amount of molding pressure needed, further facilitating making multiple pieces with one mold tool, requiring less cooling time per part, causing fewer material deformities, and causing less wear on the tool, as compared to molding frames 200 without recesses 304.

In one embodiment, the frame 200 is sufficiently flexible to conform to the shape of a wearer's body, thus preventing discomfort that might be caused by more rigid frames. In a further embodiment, however, the frame 200 is also sufficiently rigid, or resilient, to resist and distribute pressure caused by the camouflage material and/or retention devices, as extended pressure from camouflage material might also cause discomfort. Material of an appropriate hardness also prevents extension members 302 from folding down when pressure is applied, as folded extension members 302 could also cause discomfort, and would impede airflow. Accordingly, in some embodiments, the material used for the frame 200 may include a mixture of a flexible elastomer material and a more rigid plastic.

In one embodiment, the frame 200 may include a mixture of thermoplastic elastomer and polypropylene. Thermoplastic elastomer material used in some embodiments provides manufacturing advantages (e.g., when injection molding), but thermosetting elastomer material, such as other natural or synthetic rubbers, or like material may be used in other embodiments. In a certain embodiment, the mixture of thermoplastic elastomer and polypropylene comprises less than 5% polypropylene by weight. In one embodiment, the mixture of thermoplastic elastomer and polypropylene has a durometer hardness between 50 Shore A and 80 Shore A. In another embodiment, the mixture of thermoplastic elastomer and polypropylene has a durometer hardness between 60 Shore A and 70 Shore A.

In the depicted embodiment of FIGS. 2 and 3, an appropriate hardness is reached by mixing a thermoplastic elastomer (TPE) with a durometer hardness of 60 Shore A, such as a 60A TPE sold under the Kraton trademark, with less than 5% polypropylene. The hardness of the resulting material prevents pin-shaped extension members 302 having the above-disclosed dimensions from folding down when a typical range of pressures is applied to the frame 200. In various embodiments, extension members 302 of different sizes or shapes may be more or less resistant to folding when pressure is applied, and harder or softer materials may be used accordingly.

In one embodiment, scent may be a factor in selecting materials for a frame 200. For example, in a certain embodiment, the frame 200 may be made of scent-free material, so that a scent does not defeat the purpose of camouflage by alerting game to a hunter's presence. In another embodiment, additional scent may be added to the material for the frame 200, to mask the wearer's own scent, or to act as a lure.

Figure 4:
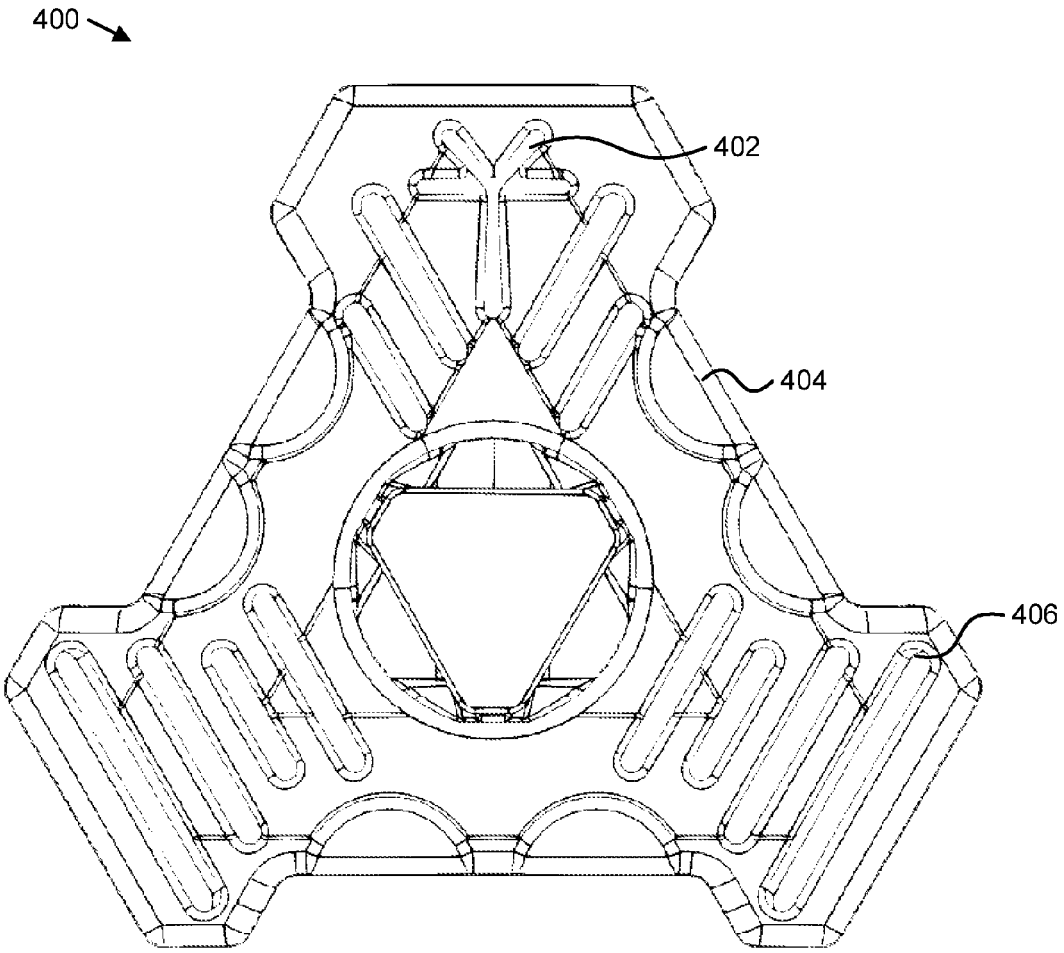
FIG. 4 is a front view illustrating another embodiment of a frame for retaining camouflage material.

FIG. 4 depicts another embodiment of a frame 400 for retaining camouflage material. In the depicted embodiment, the frame 400 includes loops 402 for elastic bands, indentations 404, and vent openings 406, which may be substantially similar to the loops, indentations, and vent openings described above with regard to FIGS. 2 and 3, like numbers referring to like elements. In certain embodiments, the frame 400 may be substantially similar to the frame 200 of FIGS. 2 and 3. In the depicted embodiment, however, the frame 400 is triangular, rather than I-shaped.

In the depicted embodiment, the frames 400 have three sides forming a triangle. The retention device (not shown) for a triangular frame 400, in certain embodiments, may be an elastic band extending along the three sides, also forming a triangle (e.g., the elastic band may be threaded through slots in the frame 408 that allow it to cover all three sides). In various embodiments, a frame 400 or elastic band with three sides and three corners may be referred to as forming a triangle even if the shape of the frame 400 or elastic band is not strictly triangular. For example, in the depicted embodiment, the frames 400 include enlarged corners for stability, but may still be referred to as triangular frames 400. Using a triangular frame 400 with elastic bands extending along the three sides of the frame 400 to form a triangle allow a user to retain camouflage material against the front of the frame at various angles, by securing the camouflage material under elastic bands on any two of the three sides.

Figure 5:
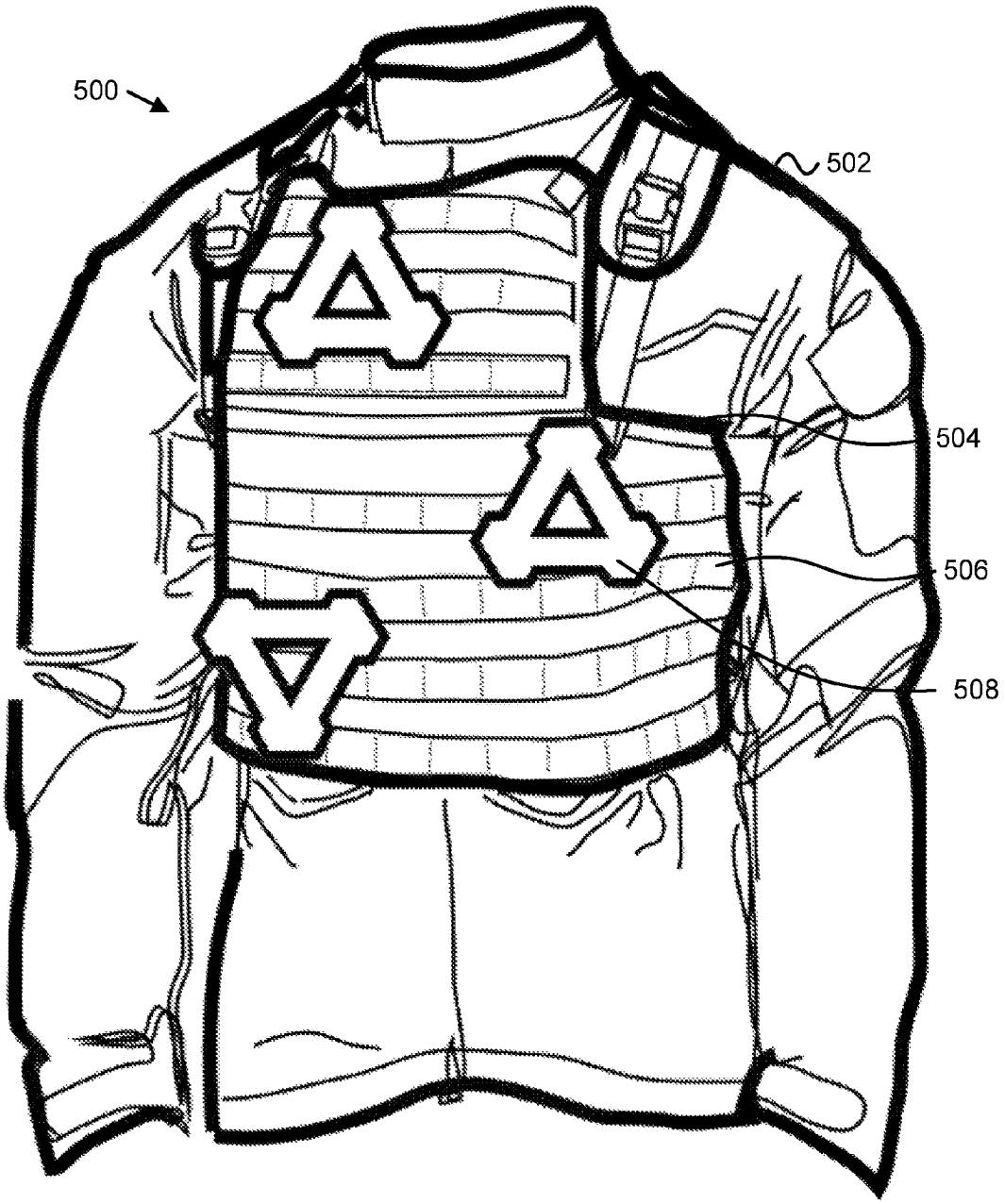
FIG. 5 is a perspective view illustrating another embodiment of a system for retaining camouflage material.

FIG. 5 depicts another embodiment of a system 500 for retaining camouflage material, used with a military uniform 502. In the depicted embodiment, the system 500 includes load-bearing equipment 504, webbing straps 506, and one or more frames 508.

The load-bearing equipment 504 is shown as part of a load-bearing system, such as Modular Lightweight Load-carrying Equipment (MOLLE), Pouch Attachment Ladder System (PALS), All-Purpose Lightweight Individual Carrying Equipment (ALICE), or the like. Many such load-bearing systems include webbing straps 506 attached to load-bearing equipment 504 such as body armor, rucksacks, or the like. In the depicted embodiment, the load-bearing equipment 504 includes body armor. However, in another embodiment, the load-bearing equipment 504 may be a backpack, rucksack, vest, belt, or other item equipped with webbing straps 506 for load carrying.

In certain embodiments, the webbing straps 506 may be used to attach items such as rifle magazines, pouches, hydration bladders, or the like, to the load-bearing equipment 504. In various embodiment, a webbing strap 506 may refer to a flat strip of strong fabric, such as nylon webbing. An array or system of webbing straps 506 provides multiple points for attaching items to the load-bearing equipment 504. For example, in the depicted MOLLE system, the load-bearing equipment 504 includes several rows of one inch webbing straps 506, spaced one inch apart, and attached to the load-bearing equipment 504 at one and one half inch intervals along the webbing straps 506. An item to be attached, such as a holster, a hydration bladder, a rifle magazine pouch, or the like, may include additional webbing, straps, elastic bands, clips, or the like, for interfacing with the webbing straps 506.

In the depicted embodiment, at least one frame 508 is attached to one of the webbing straps 506. In certain embodiments, the frames 508 may be substantially similar to the frames 108, 200, 400 described above with regard to FIGS. 1 through 4. For example, in one embodiment, a frame 508 may be the I-shaped frame 200 of FIGS. 2 and 3. In the depicted embodiment, a frame 508 may be the triangular frame 400 of FIG. 4. In another embodiment, a frame 508 may have another shape. A clip, straps, or the like may be used to attach the frame 508 to a webbing strap 506. For example, a clip for attaching triangular frames 508 to webbing straps 506 is described below with regard to FIG. 6.

In one embodiment, the system 500 includes multiple frames 508. Including multiple frames 508 allows each frame to act as a module for a modular system 508, so that various amounts of camouflage material may be retained in various positions, according to a user's needs. For example, a hunter may use a smaller number of frames 508 to camouflage the front of his or her body, for concealment from game animals. However, a soldier may use a larger number of frames to camouflage multiple sides of his or her body, for concealment from enemies in multiple directions.

In the depicted embodiment, the system 500 is used with a military uniform 502. Military users often already have load-bearing equipment 504 with webbing straps 508 where a frame 508 may be stored, or attached for camouflage purposes. However, in another embodiment, the system 500 may be used with non-military equipment or apparel.

Figure 6:
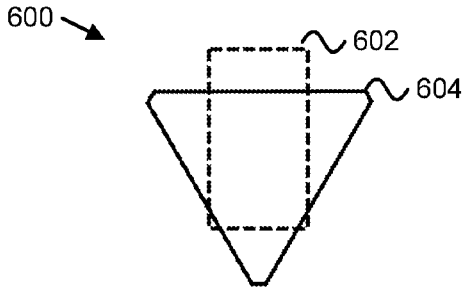
FIG. 6 is a front view illustrating one embodiment of a clip for use with the system of FIG. 5.

FIG. 6 depicts one embodiment of a clip 600 for use with the system 500 of FIG. 5. In the depicted embodiment, the clip 600 is configured to attach a frame 508 to a webbing strap 506. Triangular frames 508 in the system 500 may include a central triangular opening, as shown in FIG. 5. The central opening may reduce the weight of a frame 508, but a clip 600 may also be attached to the central opening for interfacing with a webbing strap 506, or may be removed from the central opening for using the frame 508 without a webbing strap 506. In the depicted embodiment, the clip 600 includes a back portion 602 and a triangular front portion 604.

In one embodiment, the back portion 602 is configured to interface with a webbing strap. For example, in the depicted embodiment, the back portion 602 is rectangular, and includes a U-shaped opening between rectangular layers that can slip over a webbing strap 506. In various embodiments, the back portion 602 of a clip 600 may be configured to attach to a webbing strap or straps 506 in various ways. For example, in some embodiments, the back portion 602 may be a metal clip, a spring-loaded, hinged clamp, or simply an elongate piece that can be slipped under two parallel webbing straps 506. In view of this disclosure, it is clear that the back portion 602 of a clip 600 may attach to a webbing strap 506 in a variety of different ways.

In the depicted embodiment, the front portion 604 of the clip 600 is triangular. In one embodiment, a triangular portion 604 of a clip 600 may be rotatably engageable with a triangular opening in a frame 508. In a further embodiment, the triangular front portion 604 of the clip 600 may be aligned with a triangular opening in the frame 508, and inserted (or removed) through the opening. Once inserted through the triangular opening, the clip 600 may be rotated so that the triangular front portion 604 is anti-aligned with respect to the triangular opening in the frame 508, thus securing the clip to the frame. In a certain embodiment, the front surface of the frame 508 may include detents for keeping the triangular front portion 604 of the clip 600 in the anti-aligned position until sufficient rotational force is applied, thus preventing accidental separation of the clip 600 and the frame 508.

Although the front portion 604 of the clip 600 is triangular in the depicted embodiment, it should be noted that the front portion may be another shape in another embodiment. For example, in one embodiment, a frame may include an oval-shaped opening, and the front portion 604 of the clip may be similarly oval-shaped, and rotatably engageable with the frame as described above. It is clear in light of this disclosure that a variety of shapes may be used for the front portion 604 of a clip 600, and for a corresponding opening in the frame.

In one embodiment, the clip 600 may be formed from a single piece. For example, a single piece of plastic may be molded or otherwise formed into the clip 600 of the depicted embodiment. In another embodiment, the clip 600 may be formed from multiple pieces. For example, in one embodiment, the back portion 602 may be a spring steel clip attached to a molded plastic front portion 604. In the depicted embodiment, the clip 600 is a separate piece from the frame 508. However, in another embodiment, one or more clips 600 may be integrated with the frame 508. It is clear, in view of this disclosure, that various other configurations are possible for a clip 600.

Although a clip 600 for attaching a frame 508 to a webbing strap is shown, it should be noted that in other embodiments, any of various types of mounts may be used to attach a frame 508 to various types of objects. For example, in one embodiment, a suction mount may be used to attach a frame 508 to a smooth object. In another embodiment, a magnetic mount may be used to attach a frame 508 to a steel object. In a certain embodiment, corresponding parts of a hook and loop fastener could be attached to the frame 508 and to an object, to mount the frame 508 to the object. In light of this embodiment, it is clear that various types of mount are suitable for attaching a frame 508 to an object.

Figure 7:
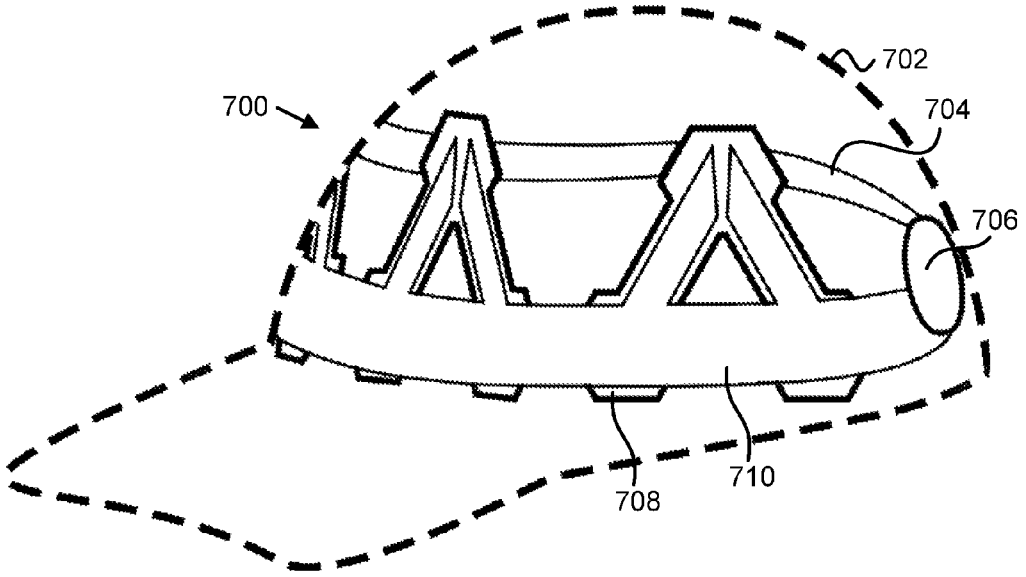
FIG. 7 is a perspective view illustrating one embodiment of an apparatus for retaining camouflage material.

FIG. 7 depicts one embodiment of an apparatus 700 for retaining camouflage material. In the depicted embodiment, the apparatus 700 includes an array of triangular frames 708. The triangular frames may be substantially similar to the frames 108, 200, 400, 508 described above with regard to FIGS. 1 through 5, and may particularly be similar to the triangular frames 400 depicted in FIG. 4. The apparatus further includes a hat 702, elastic bands 704, 710, and a fastener 706.

In various embodiments, the hat 702 may be any of various kinds of head covering, as described above with reference to the hat 104 of FIG. 1. In one embodiment, the hat 702 may be a baseball cap. In another embodiment, the hat 702 may be another hat suitable for hunting. In a different embodiment, the hat 702 may be a military helmet, or headgear for paintball. In light of this disclosure, it is clear that many different types of hat 702 may be used in various embodiments. In a further embodiment, the hat 702 includes a camouflage pattern. In another embodiment, however, the hat 702 is not itself camouflaged, as it will likely be covered by the retained camouflage material.

Fastening an array of triangular frames 708 around a hat 702 allows the hat to be camouflaged or shaded by securing camouflage material to the frames 708. Multiple frames 708 are provided in certain embodiments, to secure camouflage material on multiple sides of the hat 702. In one embodiment, the frames 708 may be slightly curved or flexible, to conform to the shape of the wearer's head.

In one embodiment, a first elastic band 704 may be threaded along the frames 708. In the depicted embodiment, the first elastic band 704 is a half-inch elastic band, and is threaded through slots in the frame 708, extending from the top of one frame 708, down one side, across the bottom, and up the other side of the frame 708, then to another frame 708 in the same manner. Thus, the first elastic band 704 connects the tops of the frames 708 and acts as a retention device running along the surface of the frames 708.

In a further embodiment, a second elastic band 710 may secure the bottoms of the frames 708 in position around the hat 702. In the depicted embodiment, the second elastic band 710 is a one inch elastic band, and extends around the front of all the frames 708, near the band of the hat 702. In another embodiment, the second elastic band may be threaded through slots in the bottom corners of the frames 708.

In certain embodiments, the elastic bands 704, 710 are retention devices as described above, for retaining camouflage against the frames 708. In a further embodiment, the elastic bands 704, 710 may also secure the array of frames 708 around the hat 702, so that the array of frames 708 is removable from the hat 702 when camouflage is not desired. In another embodiment, the frames 708 may be permanently attached to the hat 702. For example, the frames 708 may be glued to the hat 702 or sewn to the hat 702 in some embodiments.

In one embodiment, the ends of the elastic bands 704, 710 may be secured by a fastener 706. In a certain embodiment, the fastener 706 connects the elastic bands 704 710 to secure the array of frames 708 around the hat 702. In a further embodiment, the fastener 706 may allow a user to cinch the elastic bands 704, 710 more tightly around the hat 702, or to loosen the elastic bands 704, 710, to accommodate larger camouflage material. Thus in various embodiments, the fastener 706 may include a buckle, a cinching device, or the like. In light of this disclosure, many fasteners 706 are clear which may be suitable for use with the apparatus 700.

Figure 8:
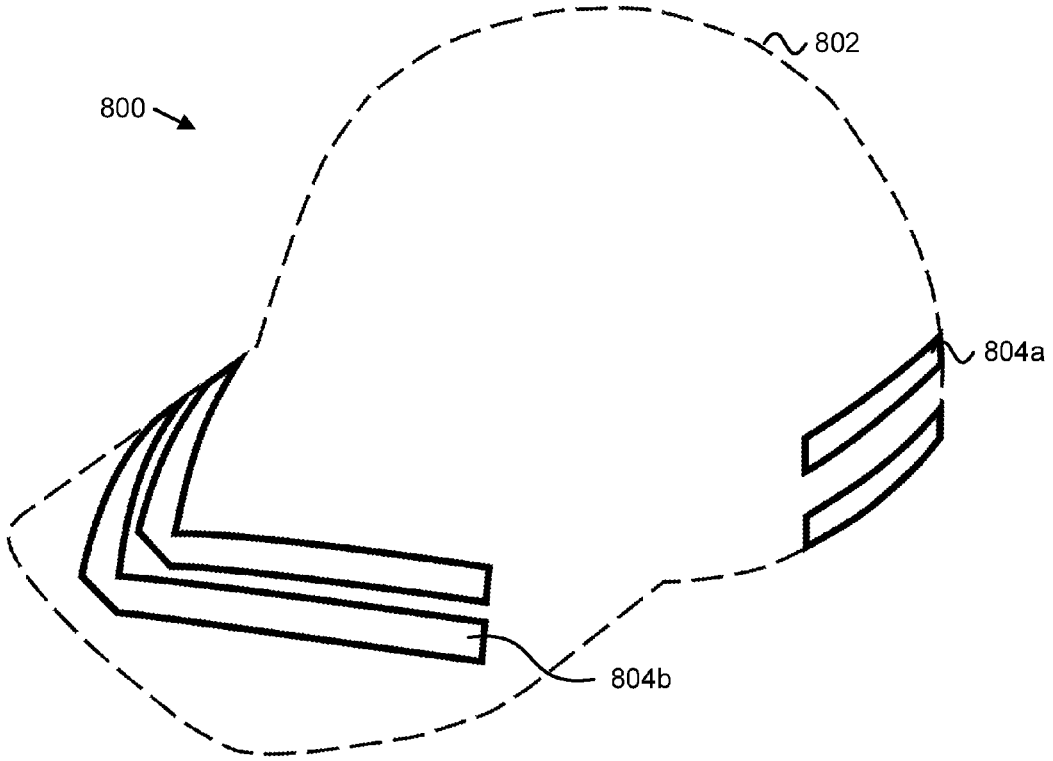
FIG. 8 is a perspective view illustrating another embodiment of an apparatus for retaining camouflage material.

FIG. 8 depicts another embodiment of an apparatus 800 for retaining camouflage material. In the depicted embodiment, the apparatus 800 includes a hat 802, which may be substantially similar to the hat 702 described above with regard to FIG. 7. In one embodiment, the apparatus 800 includes head frames inserted within the hat 802, as described above with regard to the system 100 of FIG. 1, to be used with arm and leg frames similar to the frame 200 of FIGS. 2 and 3, in a system for retaining camouflage. In one embodiment, the apparatus also includes elastic bands 804 that act as retaining devices, as described above. In general, the apparatus 800 allows camouflage material to be retained near a wearer's head.

In the depicted embodiment, elastic bands **804*a* are disposed at either side of the hat 802, near a wearer's head. In a further embodiment, rectangular frames are disposed as insets inside the hat 802, opposite the elastic bands 804*a* outside the hat. Flexible frames in the hat 802 act as head guards, distributing the pressure from camouflage material such as branches, foliage and the like to prevent discomfort. In a certain embodiment, extension members in the head guards allow airflow, as described above. In one embodiment, additional elastic bands 804*b* are disposed on the brim of the hat 802. In some embodiments, the brim of the hat 802 provides sufficient support for camouflage material, and separates the camouflage material from a wearer's head, so that frames are not required for use with the additional elastic bands 804*b***.

Figure 9:
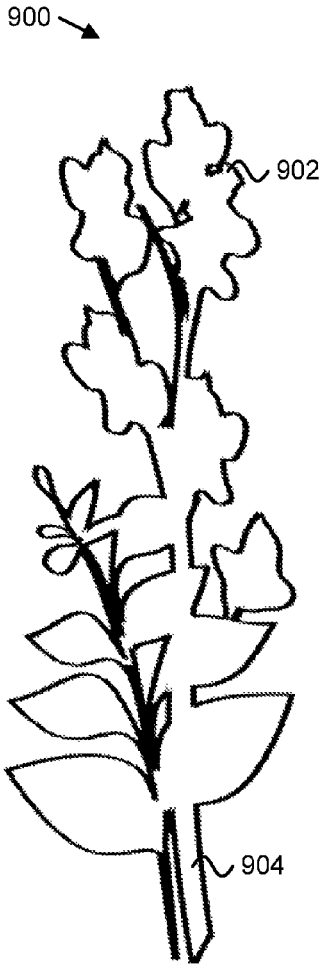
FIG. 9 is a front view illustrating one embodiment of artificial plant material.
Figure 10:
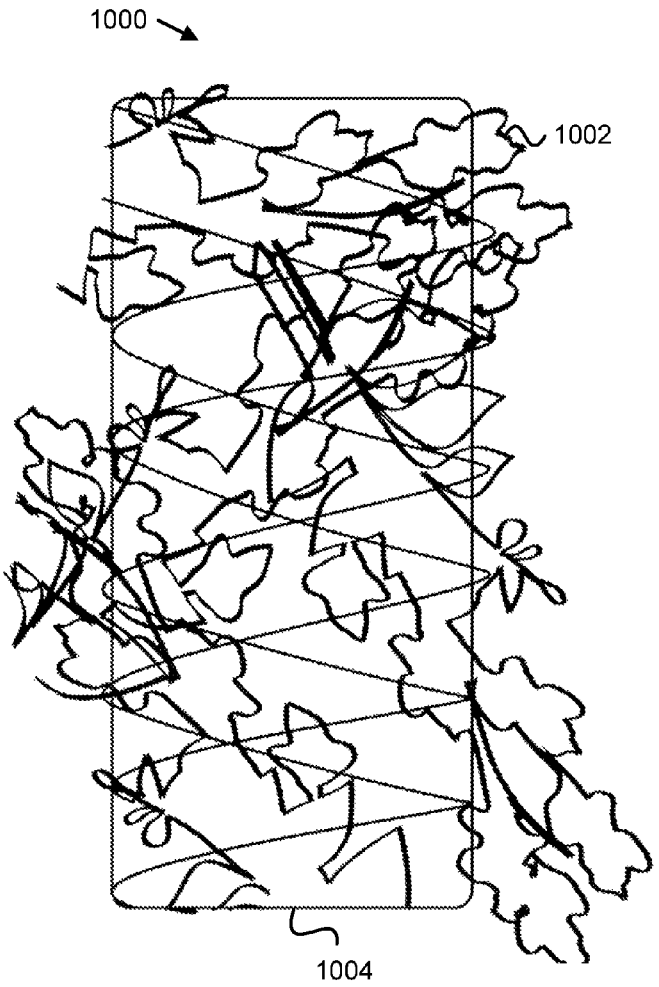
FIG. 10 is a front view illustrating another embodiment of artificial plant material.

FIGS. 9 and 10 depict two embodiments of artificial plant material 900, 1000. In certain embodiments, artificial plant material 900, 1000 may include artificial leaves 902, 1002, and stems 904, or other support for the leaves 902, 1002, such as a support lattice 1004. As used herein, "artificial plant material" may refer to any material that acts like a plant to break up the outline of a camouflaged object and/or provide a different appearance from different angles, whether or not the artificial plant material closely resembles a plant. For example, in one embodiment, artificial plant material may be designed with "leaves" (as described below) that resemble wastepaper, so that a wearer resembles a trash heap. Nevertheless, this camouflage material may still be described as artificial plant material.

In general, artificial plant material 900, 1000, may provide lightweight camouflage, in a variety of shapes, colors, patterns, prints, textures, etc. In certain embodiments, artificial plant material 900, 1000 may be used to avoid cutting natural foliage. For example, people in wilderness environments may attempt to leave no trace, by avoiding cutting natural plants. Similarly, children playing with camouflage may not be allowed to cut natural foliage from their yard or neighborhood. In some embodiments, artificial plant material 900, 1000 may be miniaturized for children to use when playing with toy figures. In other embodiments, artificial plant material 900, 1000 may include advanced camouflage fabrics or other materials to offer specific camouflage kits for specific environments, such as desert, woodlands, snow, with lighter weight and greater durability than natural camouflage material. Specific artificial camouflage kits may also be created in bright colors for costume use, paintballing, or the like. In certain embodiments, artificial plant material 900, 1000 may also be softer and more comfortable than natural plant material. In some embodiments, artificial plant material 900, 1000, may be designed for portability. For example, in some embodiments, artificial plant material 900, 1000 may be made from thin material, easily collapsed, folded, or rolled up, for portability. In one embodiment, a user may carry plant material 900, 1000 for use as a base layer of camouflage, and supplement it with a smaller amount of natural plant material than the user would otherwise need for effective camouflage. In one embodiment, artificial plant material 900, 1000 may roll up, or collapse into a tube for transportation, as described below with regard to FIG. 11. Artificial plant material 900, 1000 may have further uses. For example, in another embodiment, the camouflage material itself may collect or store energy from a wearer's motion or body heat.

In one embodiment, the artificial plant material 900 may be designed to closely resemble natural plants. For example, in one embodiment, a leaf 902 may resemble a natural leaf, and may be attached to a natural-looking stem 904. A leaf 902 may be made of fabric, plastic film or other flexible material, and the step 904 may be made of plastic or stiffer material. Currently available artificial plants for decoration often include fabric leaves with a tube sewn in the leaf that slips over a plastic stem. While useful for decoration, such artificial plants may lose leaves if used more vigorously for camouflage. Accordingly, in some embodiments, artificial leaves 902 may be fused, glued, locked, or otherwise securely affixed to the stem 904.

In one embodiment, the stem 904, resembling a natural plant stem, may be formed as a single piece. In another embodiment, the stem 904 may include multiple pieces that are securely attached together. For example, a branching piece may be clipped, locked, screwed on, or adhered to the end of another piece.

In another embodiment, artificial plant material 1000 may be less similar to natural plant material. In general, leaves 1002 may camouflage a wearer by changing a wearer's color or breaking up a wearer's outline. Thus, in some embodiments, artificial leaves 1002 may include different colors than natural leaves for camouflage in non-vegetated environments. For example, artificial leaves 1002 may include colors or patterns to disguise a wearer in wood, sand, snow, brick, or concrete environments, or the like. In another embodiment, artificial leaves 1002 may be shaped in natural leaf shapes or in artificial shapes, but may still break up a wearer's outline. For example, in one embodiment, artificial leaves 1002 may be hexagonal, but may still be used to break up the wearer's outline.

In one embodiment, artificial leaves 1002 may have optical properties that do not resemble natural leaves. For example, in one embodiment, the leaves 1002 may be clear enough to transmit light but may distort what is behind them. In another embodiment, the leaves 1002 may comprise mesh material that a close-by wearer can see through, but that appears opaque to a far-off observer. In a certain embodiment, the leaves 1002 may include a surface treatment that reduces a wearer's infrared signature.

In certain embodiments, a plurality of artificial leaves 1002 may be supported for use as camouflage with the use of a natural-appearing stem. For example, in the depicted embodiment, a support lattice 1004 may be a lattice formed of cloth, string, or other flexible material, to which leaves 1002 are attached at various points. In one embodiment, a support lattice 1004 may be substantially flat. In another embodiment, a support lattice 1004 may include three dimensional shapes, such as a coil or helix. Using a flat lattice, coil, or helix instead of a branching stem 904 allows a support lattice 1004 to be collapsed, rolled, or folded up for easy transportation In certain embodiments, artificial plant material 1000 may be softer or more comfortable than natural plant material. Accordingly, in one embodiment, artificial plant material 1000 may be attached directly to a wearer's clothing without using a frame or retention devices as described above. For example, snaps, buttons, toggles, or other fasteners may be used to fasten artificial plant material 1000 comfortably to clothing. In another embodiment, artificial leaves 1002 may be worn comfortably without a frame or support lattice 1004, by attaching leaves 1002 directly to an article of apparel. Artificial plant material 1000 may also be useful for camouflaging other items that might be scratched by natural camouflage material. For example, artificial plant material 1000 may be wrapped around a vehicle, wheelchair, or the like, for camouflage.

In one embodiment, the artificial plant material 900, 1000 may include a collector for water, for solar energy, motion energy, or other forms of energy. In various embodiments, a collector may refer to portion of artificial plant material 900, 1000 that collects energy or other resources based on its structure. For example, in one embodiment, artificial plant material 900 may include a hollow stem 904, and leaves 902 may act as collectors to funnel rainwater or dew into the hollow stem 904, because the structure of the leaves 902 provides a large surface for collecting water. In another embodiment, artificial plant material 900, 1000 may include electrical connections in a stem 904 or support lattice 1004, and leaves 902, 1002 may include photovoltaic elements that act as collectors to convert solar energy into electrical energy which may be stored in a battery. In a further embodiment, solar electrical energy may be used with a catalyst to electrolyze water, creating hydrogen fuel that can be stored and used in a fuel cell. In another embodiment, artificial plant material 900, 1000 may collect and store energy from the motion of the leaves 902, 1002, using a mechanism similar to the mechanism of a self-winding watch.

In one embodiment, the frame may store the collected water or energy. For example, a frame may include a built-in reservoir for collected water. In another embodiment, a frame may include flexible plastic or rubber material molded over a flexible battery for storing electrical energy. However, in another embodiment, a reservoir, fuel cell, battery or the like may be provided separate from the frames.

Figure 11:
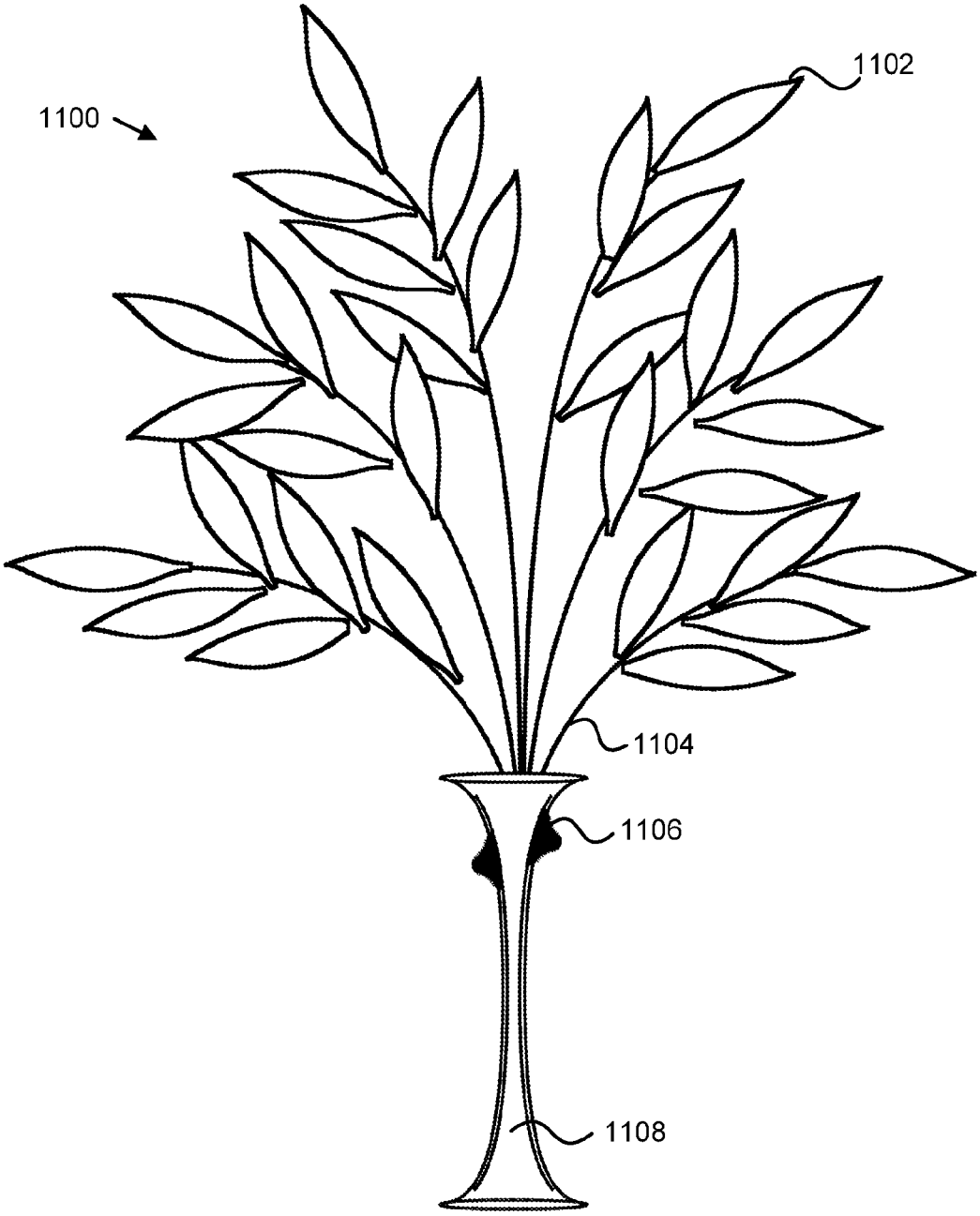
FIG. 11 is a front view illustrating another embodiment of artificial plant material.

FIG. 11 depicts another embodiment of artificial plant material 1100. In certain embodiments, the artificial plant material 1100 may be substantially similar to the artificial plant material 900, 1000 described above with regard to FIGS. 9 and 10, including leaves 1102 and stems 1104 similar to the leaves 902 and stem 904 depicted in FIG. 9. In the depicted embodiment, the artificial plant material 1100 includes a tube 1108 for storing the leaves 1102 and stems 1104, and one or more thumb-operated slides 1106 for collapsing the leaves 1102 and 1104 into the tube.

In the depicted embodiment, the stems 1104 include multiple linear stems, instead of a branching stem similar to the stem 904 of FIG. 9. Using multiple linear stems 1104 allows the artificial plant material 1100 to be easily collapsed. However, in another embodiment, the artificial plant material 1100 may include another type of stem 1104 designed for collapsibility. For example, a collapsing stem 1104 may be similar to the stem or stems of a novelty artificial bouquet that collapses into a tube to be hidden in, and suddenly retrieved from, a magician's sleeve.

In one embodiment, the tube 1108 is sized to store the collapsed artificial plant material 1100. In a certain embodiment, artificial plant material 1100 may be collapsed into a tube 1108 for compact transportation and storage. In one embodiment, the tube 1108 may be cylindrical, for easy transportation of multiple tubes 1108 in an array. In another embodiment, as depicted, the tube may have flared ends, allowing artificial plant material to spread out. In a further embodiment, a tube 1108 may be coiled to provide even more compact storage of the artificial plant material. In one embodiment, a straight tube 1108 may be open at both ends, and camouflage material may be retracted into the tube 1108 or extended above and below the tube 1108 before retaining the tube 1108 against a frame for camouflage. In another embodiment, a straight or coiled tube 1108 may be open at only one end.

In one embodiment, the tube 1108 may be intended for one time storage off the artificial plant material 1100, which may expand when removed from the tube 1108. In another embodiment, the artificial plant material 1100 may be reinserted into the tube stem-first, and collapsed as it is pulled into the tube 1108. In certain embodiments, the tube 1108 may be intended for repeated storage of the artificial plant material. In further environments, a device such as a thumb-operated slide 1106, a pull cord, or the like may engage the stems 1104 through the wall of the tube 1108 to extend or retract the artificial plant material 1100. In the depicted embodiment, two thumb-operated slides 1106 are provided to extend or retract camouflage material from both the top and the bottom of the tube 1108.

Figure 12:
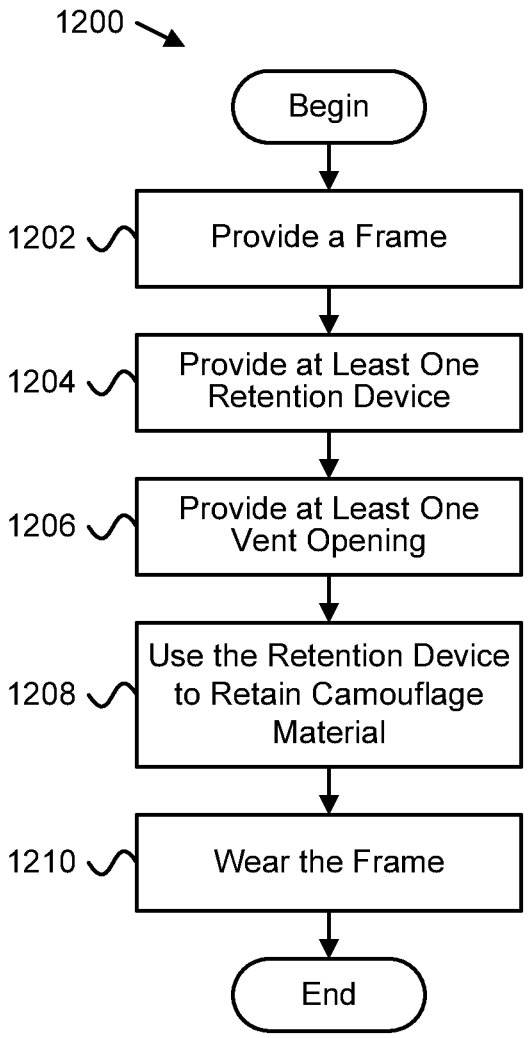
FIG. 12 is a schematic flow chart diagram illustrating one embodiment of a method of retaining camouflage material.

FIG. 12 depicts one embodiment of a method 1200 of retaining camouflage material. The method 1200 begins, and a frame is provided 1202. The frame may include a front surface and a back surface, and may be configured to distribute pressure across the back surface from camouflage material retained against the front surface. One or more retention devices are provided 1204, coupled to the frame. At least one vent opening is provided 1206, formed in the frame. The vent opening may include a channel extending between the front surface and the back surface of the frame. The retention device is used 1208 to retain camouflage material against the front surface of the frame. The frame is worn 1210 (or attached to an object) to camouflage the wearer (or object) and the method 1200 ends. In one embodiment, the method 1200 further comprises adapting to new surroundings by replacing the camouflage material with new camouflage material.

Although some of the embodiments of the apparatus, system, and method disclosed herein have been described as useful for camouflage, it is recognized that the embodiments of the present disclosure may also be operable in other ways, or for other purposes. For example, in one embodiment, material such as camouflage material may be secured to a hat to provide shade. Alternatively, in another embodiment, an apparatus for securing camouflage material could be used to secure non-camouflage material. For example, a similar apparatus could be used to secure bright or easily noticeable materials in a team color, or for a theatrical costume.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for retaining camouflage material, the apparatus comprising:

a frame comprising a front surface and a back surface, the frame configured to distribute pressure across the back surface from camouflage material retained against the front surface;

at least one retention device coupled to the frame, the at least one retention device configured to retain camouflage material against the front surface of the frame, the at least one retention device comprising an elastic band, the elastic band comprising a front layer and a back layer, the front layer permanently fixed to the back layer in at least two positions to form one or more loops between the at least two positions, wherein at least one of the one or more loops is positioned entirely in front of the frame;

an array of extension members extending from the back surface of the frame, the extension members protruding from the back surface of the frame at a height sufficient to allow airflow between the frame and a wearer; and at least one vent opening formed in the frame, the vent opening comprising a channel extending between the front surface and the back surface of the frame.

2. The apparatus of claim 1, wherein the frame is sufficiently flexible to conform to a part of a wearer's body.

3. The apparatus of claim 2, wherein the frame is sufficiently stiff to resist indentation due to pressure from camouflage material.

4. The apparatus of claim 1, wherein the frame is integrated with an article of apparel.

5. The apparatus of claim 1, wherein the frame comprises two transverse portions and a longitudinal portion, the longitudinal portion extending between the two transverse portions, and the at least one retention device comprises two elastic bands, each elastic band comprising a middle portion coupled to one of the two transverse portions of the frame, and end portions extending beyond the frame for fastening around an object.

6. The apparatus of claim 1, wherein the frame comprises three sides and the at least one retention device comprises an elastic band extending along the three sides to form a triangle.

7. The apparatus of claim 1, wherein the back surface comprises an array of recesses.

8. The apparatus of claim 1, wherein the camouflage material comprises natural plant material.

9. The apparatus of claim 1, wherein the camouflage material comprises artificial plant material.

10. The apparatus of claim 9, wherein the artificial plant material comprises a collector for one or more of solar energy, motion energy, and water.

11. The apparatus of claim 1, further comprising a clip configured to attach the frame to a webbing strap.

12. The apparatus of claim 11, wherein the clip comprises a triangular portion rotatably engageable with a triangular opening in the frame.

13. A system for retaining camouflage material, the system comprising:

at least one frame comprising a front surface and a back surface, the frame configured to distribute pressure across the back surface from camouflage material retained against the front surface; and two elastic bands, each elastic band comprising a middle portion coupled to the frame for retaining camouflage material against the front surface of the frame and end portions extending beyond the frame for fastening around an object, wherein at least one of the elastic bands comprises a front layer and a back layer, the front layer permanently fixed to the back layer in at least two positions to form one or more loops between the at least two positions, wherein at least one of the one or more loops is positioned entirely in front of the frame, wherein the frame is sufficiently flexible to conform to a part of a wearer's body.

14. The system of claim 13, further comprising at least two additional elastic bands, a color of the at least two additional elastic bands differing from a color of the two elastic bands coupled to the frame.

15. A method for retaining camouflage material, the method comprising:

providing a frame comprising a front surface and a back surface, the frame configured to distribute pressure across the back surface from camouflage material retained against the front surface;

providing at least one retention device coupled to the frame, the at least one retention device comprising two elastic bands, each elastic band comprising a middle portion coupled to the frame for retaining camouflage material against the front surface of the frame and end portions extending beyond the frame for fastening around an object, wherein at least one of the elastic bands comprises a front layer and a back layer, the front layer permanently fixed to the back layer in at least two positions to form one or more loops between the at least two positions, wherein at least one of the one or more loops is positioned entirely in front of the frame;

providing at least one vent opening formed in the frame, the vent opening comprising a channel extending between the front surface and the back surface of the frame;

using the retention device to retain camouflage material against the front surface of the frame; and wearing the frame.

16. The method of claim 15, further comprising adapting to new surroundings by replacing the camouflage material with new camouflage material.

* * * * *